US007617608B2

(12) United States Patent
Zakarian

(10) Patent No.: US 7,617,608 B2
(45) Date of Patent: Nov. 17, 2009

(54) HACKSAW FRAME HAVING A FILE AS AN INTEGRAL PART THEREOF

(75) Inventor: Artin J. Zakarian, 9903 Wonderful Day Dr., Las Vegas, NV (US) 89148

(73) Assignee: Artin J. Zakarian, Las Vegas, NV (US)

( * ) Notice: Subject to any disclaimer, the term of this patent is extended or adjusted under 35 U.S.C. 154(b) by 157 days.

(21) Appl. No.: 11/633,847

(22) Filed: Dec. 4, 2006

(65) Prior Publication Data

US 2008/0127499 A1 Jun. 5, 2008

(51) Int. Cl.
*B26B 11/00* (2006.01)
*B27B 21/02* (2006.01)

(52) U.S. Cl. ..... 30/514; 30/507; 30/512; 407/29.1; 7/149; 7/158

(58) Field of Classification Search ..... 30/329, 30/332, 337, 340, 342, 506–514, 517–520; D8/95–97, 105–107; 407/29.1, 29.15; 7/148–150, 7/158–163, 167, 170
See application file for complete search history.

(56) References Cited

U.S. PATENT DOCUMENTS

| | | | | | |
|---|---|---|---|---|---|
| 286,124 | A | * | 10/1883 | Fairbanks | 279/9.1 |
| 945,828 | A | * | 1/1910 | Reding et al. | 30/519 |
| 1,529,472 | A | * | 3/1925 | Falos | 407/29.15 |
| 2,245,983 | A | * | 6/1941 | Knowles | 76/31 |
| 2,504,473 | A | | 4/1950 | Van Antwerpen | |
| 2,642,906 | A | * | 6/1953 | Faubion | 30/513 |
| 2,682,286 | A | * | 6/1954 | Barker | 30/513 |
| 2,804,732 | A | * | 9/1957 | Brockley | 451/557 |
| 2,951,521 | A | * | 9/1960 | Sicard | 30/502 |
| 3,038,177 | A | * | 6/1962 | Machtle | 7/144 |
| 3,392,606 | A | * | 7/1968 | Wilson | 76/36 |
| 3,798,687 | A | | 3/1974 | Stevens | |
| 3,867,853 | A | * | 2/1975 | Lawless | 76/36 |
| 3,874,126 | A | * | 4/1975 | Catlin et al. | 451/525 |
| 4,376,456 | A | * | 3/1983 | Jacoff | 30/506 |
| 4,646,405 | A | * | 3/1987 | Reinhold | 407/29.15 |
| 5,382,319 | A | | 1/1995 | Tumminaro, Jr. | |
| 5,471,752 | A | | 12/1995 | Koetsch | |
| 5,622,090 | A | | 4/1997 | Marks | |
| 5,706,585 | A | * | 1/1998 | Wang | 30/512 |
| 5,722,173 | A | * | 3/1998 | Huang | 30/510 |
| 5,752,285 | A | * | 5/1998 | Bendheim et al. | 7/167 |
| 5,762,344 | A | * | 6/1998 | Einvall | 279/96 |
| 5,791,209 | A | | 8/1998 | Marks | |
| 6,085,619 | A | | 7/2000 | Blake et al. | |
| 6,230,412 | B1 | | 5/2001 | Lin | |
| 6,457,244 | B1 | | 10/2002 | Huang | |
| D472,445 | S | | 4/2003 | Juhlin et al. | |
| 6,606,795 | B2 | | 8/2003 | Erisoty et al. | |
| 6,684,515 | B1 | | 2/2004 | Clark | |

(Continued)

*Primary Examiner*—Boyer D. Ashley
*Assistant Examiner*—Edward Landrum

(57) ABSTRACT

A hacksaw having a frame that includes a back handle and an elongated beam that has a series of ridges on at least one or more surfaces of the elongated beam that form a file for reducing and smoothing surfaces of an article. The elongated beam has a first distal end coupled with a first back handle section. A hacksaw blade is coupled with the back handle and a fore piece coupled to a second distal end of the elongated beam.

3 Claims, 20 Drawing Sheets

U.S. PATENT DOCUMENTS

| | | | | |
|---|---|---|---|---|
| D489,242 | S | 5/2004 | Snider | |
| 6,772,522 | B1 | 8/2004 | Huang et al. | |
| D504,802 | S | 5/2005 | Heneen et al. | |
| 6,959,847 | B2 | 11/2005 | Park | |
| D514,418 | S | 2/2006 | Critelli et al. | |
| 7,003,833 | B2 | 2/2006 | Feliciano | |
| D519,350 | S | 4/2006 | Critelli et al. | |
| 2004/0187219 | A1* | 9/2004 | Beal | 7/158 |
| 2005/0172416 | A1 | 8/2005 | Feliciano | |
| 2005/0193498 | A1 | 9/2005 | Klecker et al. | |
| 2006/0010696 | A1 | 1/2006 | Criteli | |
| 2006/0070186 | A1 | 4/2006 | Karlstedt | |

* cited by examiner

700

700

HACKSAW FRAME HAVING A FILE AS AN INTEGRAL PART THEREOF

BACKGROUND OF THE INVENTION (1) Field of the Invention

The present invention relates to a hacksaw frame, and more particularly, to a hacksaw frame having a file as an integral part thereof (2) Description of Related Art In general, a hacksaw is a well-known hand tool primarily used for cutting surfaces of an article such as a metal, and includes typically a blade that is detachably fixed in a frame of the hacksaw. As is apparent to those skilled in the art that have used hacksaws to cut various components, the surface area of the severed sections of the cut articles are generally left with rough edges as a result of the cut, which are often smoothed for a clean, finish product for later user. Hence, in most (if not all) cases, smoothing of the rough edges of a severed article is necessary. Accordingly, a separate, second tool such as a file is generally used to even the rough edges of cut surfaces. A file is a well-known hand tool that is generally made of metal or the like having a series of ridges on its surfaces for reducing or smoothing rough surfaces of a cut article, such as metal. Therefore, after using a hacksaw for cutting an article, it is usually necessary to reach for a file to smooth the resulting rough edges of the severed article for a clean finish. In view of the above and as apparent to those skilled in the art, the act of cutting requires the purchase of and storage space for two separate tools, a hacksaw and at least one file.

As is apparent from the following exemplary U.S. Patent Publications related to hacksaws and files, most conventional hacksaw frames suffer from obvious disadvantages in that they are only used for securing a hacksaw blade and for cutting an article, and do not function as a file to smooth out an already cut surface, and a file is used for smoothing surfaces of an already cut article, and cannot be used (at least efficiently) for cutting. A few, exemplary, related U.S. patents include D519,350; D514,418; D504,802; D489,242; D472,445; U.S. Pat. Nos. 7,003,833; 6,959,847; 6,772,522; 6,684,515; 6,606,795; 6,457,244; 6,230,412; 5,471,752; 5,382,319; 3,798,687; 2,504,473; and the U.S. Patent Application Publication 2005/0193498; 2005/0172416; 2006/0070186; and 2006/0010696.

In light of the current state of the art and the drawbacks to current hacksaws and files mentioned above, a need exists for a multi-device tool that would provide true complementary utility between the various individual functions thereof In particular, a need exists for a hacksaw frame having a blade that would cut articles and that would include as an integral part of the hacksaw frame a file that would be used to reduce or smooth rough edges of severed surfaces as a result of the cut article.

BRIEF SUMMARY OF THE INVENTION

One aspect of the present invention provides a hacksaw, comprising:

a structure having a frame, including:

back handle;

an elongated beam that has a series of ridges on at least one or more surfaces of the elongated beam for reducing and smoothing surfaces of an article, with the elongated beam having a first distal end coupled with a first back handle section; and a hacksaw blade coupled with the back handle and the elongated beam.

One optional aspect of the present invention provides a hacksaw, wherein:

the elongated beam is a file.

Another optional aspect of the present invention provides a hacksaw, wherein:

the hacksaw blade includes a first end and a second end;

the first end of the hacksaw blade is coupled with a second distal end of the file, and the second end of the hacksaw blade is coupled with a second back handle section.

Yet another optional aspect of the present invention provides a hacksaw, wherein:

the first back handle section is comprised of a receiving channel for detachably and securely coupling the first distal end of the file therewith.

Still another optional aspect of the present invention provides a hacksaw, wherein:

the first back handle section is comprised of a radial array of receiving channels;

the radial array of receiving channels is configured commensurate with a cross-section of one of a first and second distal ends of the file, allowing the elongated beam to be rotated along a longitudinal axis of the elongated beam, and be detachably and securely coupled with the back handle.

A further optional aspect of the present invention provides a hacksaw, wherein:

the first back handle section is comprised of a radial array of receiving channels;

one or more of a receiving channels of the radial array of receiving channels are configured commensurate with a cross-section of one of the first and the second distal ends of the file, allowing the file to be rotated along a longitudinal axis of the file, and be detachably and securely coupled with the back handle.

Yet a further optional aspect of the present invention provides a hacksaw, wherein:

the frame is comprised of a single piece structure.

Another optional aspect of the present invention provides a hacksaw, wherein:

a section of the elongated beam having the series of ridges for reducing and smoothing an article has a polygonal cross-section.

Yet another optional aspect of the present invention provides a hacksaw, wherein:

a section of the elongated beam having the series of ridges for reducing and smoothing an article has a semi-circular cross-section on at least one side thereof.

Still another optional aspect of the present invention provides a hacksaw, wherein:

a section of the elongated beam having the series of ridges for reducing and smoothing an article has a circular cross-section.

A further optional aspect of the present invention provides a hacksaw, wherein:

a section of the elongated beam having the series of ridges for reducing and smoothing an article has a prismatic cross-section.

Yet a further optional aspect of the present invention provides a hacksaw, wherein:

the back handle has a receiving channel for detachably securing the file.

Still a further optional aspect of the present invention provides a hacksaw, wherein:

the back handle has a receiving channel that is configured commensurate with a cross-section of the file.

Another optional aspect of the present invention provides a hacksaw, wherein:

the structure further includes a fore piece, with the file coupled in between the fore piece and the back handle.

Yet another optional aspect of the present invention provides a hacksaw, wherein:

the fore piece includes a first front section, where the file is coupled in between the first front section and the first back handle section.

Still another optional aspect of the present invention provides a hacksaw, wherein:

the hacksaw blade includes a first end and a second end;

the first end of the hacksaw blade is coupled with a second front section, and the second end of the hacksaw blade is coupled with a second back handle section.

A further optional aspect of the present invention provides a hacksaw, wherein:

the fore piece and the back handle are comprised of receiving channels for detachably and securely coupling of the first distal end and the second distal end of the file with the receiving channels of the fore handle and the back handle.

Yet a further optional aspect of the present invention provides a hacksaw, wherein:

the first fore section is comprised of a first radial array of receiving channels;

the first back handle section is comprised of a second radial array of receiving channels;

the first radial array of receiving channels is configured commensurate with the cross-section of a first distal end of the file, and the second radial array of receiving channels is configured commensurate with the second distal end of the file, allowing the file to be rotated along a longitudinal axis of the file, and be detachably and securely coupled with the fore piece and the back handle.

Still a further optional aspect of the present invention provides a hacksaw, wherein:

the first fore section is comprised of a first radial array of receiving channels;

the first back handle section is comprised of a second radial array of receiving channels;

the first radial array of receiving channels is configured commensurate with a cross-section of one of a first and second distal ends, and the second radial array of receiving channels is configured with cross-section of the other of the first and the second distal ends, allowing the file to be rotated along a longitudinal axis of the file, and be detachably and securely coupled with the fore handle and the back handle.

Another optional aspect of the present invention provides a hacksaw, wherein:

the first fore section is comprised of a first radial array of receiving channels;

the first back handle section is comprised of a second radial array of receiving channels;

one or more of a first receiving channels of the first radial array of receiving channels is configured commensurate with a cross-section of one of a first and second distal ends, and one or more of a second receiving channels of the second radial array of receiving channels is configured commensurate with a cross-section of the other of the first and the second distal ends, allowing the file to be rotated along a longitudinal axis of the file, and be detachably and securely coupled with the fore handle and the back handle.

Yet another optional aspect of the present invention provides a hacksaw, wherein:

the fore piece and the back handle have receiving channels for detachably securing the file.

Still another optional aspect of the present invention provides a hacksaw, wherein:

the fore piece and the back handle have receiving channels that are configured commensurate with a cross-section of the file.

A further optional aspect of the present invention provides a hacksaw, wherein:

the fore piece is a beam that has a series of ridges on at least one or more surfaces of the fore piece for reducing and smoothing surfaces of an article, the beam includes a first beam section, where the file is coupled in between the first beam section and the first back handle section.

Yet a further optional aspect of the present invention provides a hacksaw, wherein:

a hacksaw blade having a first end and a second end;

the first end of the hacksaw blade is coupled with a second beam section, and the second end of the hacksaw blade is coupled with a second back handle section.

Another aspect of the present invention provides a hacksaw, comprising:

a structure having a frame, including:

back handle;

fore piece that has a series of ridges on at least one or more surfaces of the fore piece for reducing and smoothing surfaces of an article;

an elongated beam, with the elongated beam having a first distal end coupled with a first back handle section, and a second distal end coupled with a first fore piece section; and a hacksaw blade coupled with the back handle and the fore piece.

Still another aspect of the present invention provides a hacksaw, comprising:

a structure having a frame, including:

a handle;

first elongated beam that has a series of ridges on at least one or more surfaces of the first elongated beam for reducing and smoothing surfaces of an article;

a second elongated beam that has a series of ridges on at least one or more surfaces of the second elongated beam for reducing and smoothing surfaces of an article;

the first elongated beam has a first distal end that is coupled with one of a first handle section and a second handle section;

the second elongated beam has a second distal end that is coupled with another of first handle section and the second handle section; and a hacksaw blade coupled with a third distal end of the first elongated beam and a fourth distal end of the second elongated beam.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The present invention provides a hacksaw with a file as an integral part of the frame of the hacksaw. Hence, after using the hacksaw for cutting an article, the file as an integral part of the frame of the hacksaw of the present invention may be used to smooth the resulting rough edges. Accordingly, in view of the present invention, the act of cutting an article no longer requires the purchase of and storage space for two separate tools, such as a separate conventional hacksaw and a separate conventional file because the present invention provides both within a single tool. An added benefit of the present invention is that no new skills are required for using the hacksaw disclosed. That is, the hacksaw of the present invention may be used in a conventional manner to cut articles, and the file that is integral therewith the frame of the hacksaw may also be used in a conventional manner to smooth out any rough edges of an article. A further added benefit of the present invention is that the handles of the hacksaw provide a secure grip for a user when both cutting and filing, allowing the user improved control for both processes.

Figure 1A:
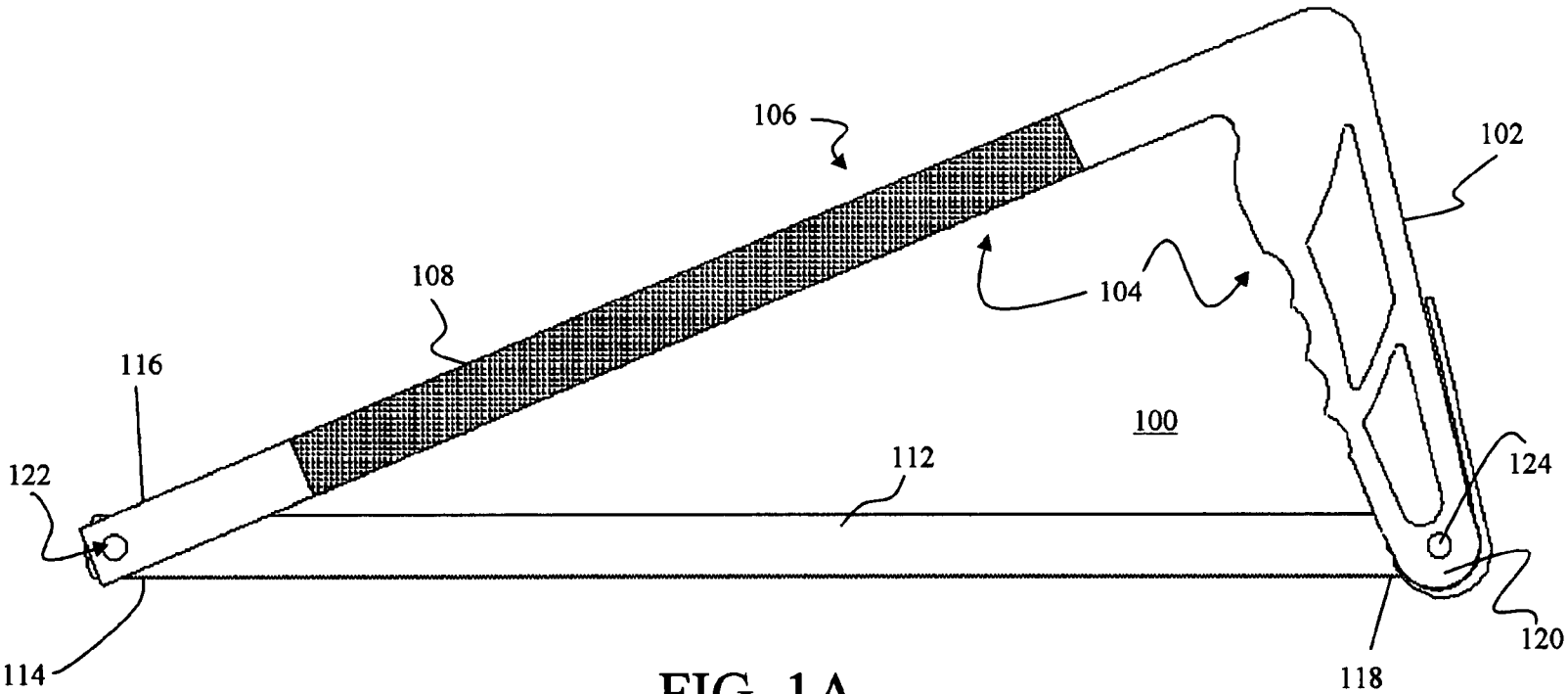
FIG. 1A is an exemplary illustration of a single piece, three-sided hacksaw with a file as an integral part of the frame of the hacksaw in accordance with the present invention.

FIG. 1A is an exemplary illustration of a hacksaw in accordance with the present invention. As illustrated, the hacksaw 100 is comprised of a structure having a single piece frame 104, which is comprised of a back handle section 102 and an elongated beam section 106. The elongated beam section 106 is comprised of a file 108 that has a series of ridges on at least one or more surfaces thereof for reducing and smoothing surfaces of an article (not shown). The hacksaw 100 further includes a hacksaw blade 112 with a first end 114 coupled with a distal end 116 of the elongated beam section 106 of the frame 104, and a second end 118 coupled with a lower back handle section 120 of the frame 104. The mechanism 122 for connection of the first end 114 of the hacksaw blade 112 with the distal end 116 of the elongated beam section 106 is conventional and well-known, non-limiting example of which may include simple fasteners, for example, screws, bolts with wing nuts, etc. The connection mechanism 124 for the second end 118 of the hacksaw blade 112 with the lower back handle section 120 is conventional and well known, and may further include any type of well-known blade tensioning mechanism 410 (first illustrated in FIG. 4A).

Figure 1B:
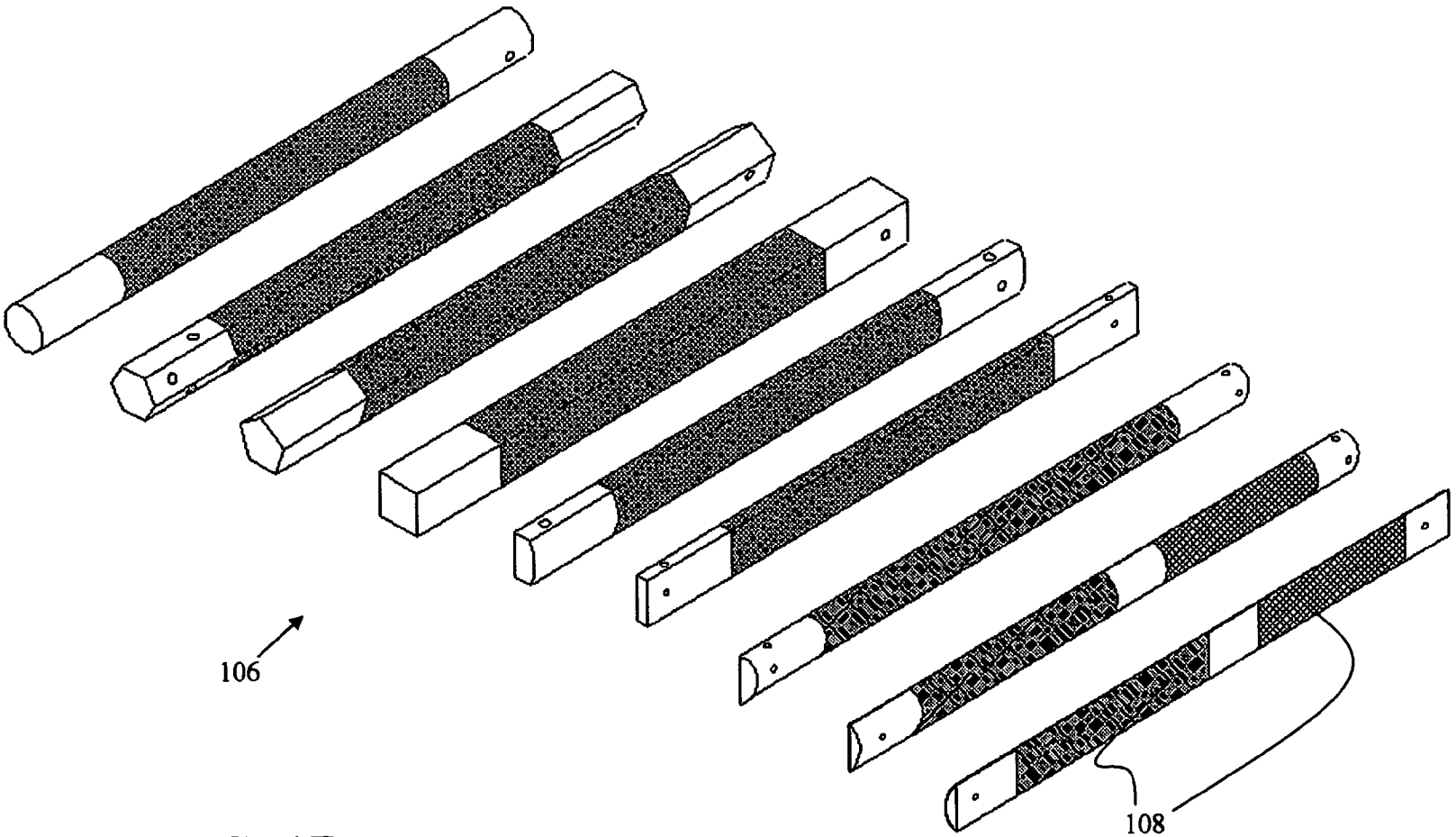
FIG. 1B is an exemplary illustration of a few, non-limiting exemplary files with exemplary cross-sections that can be used with any of the exemplary hacksaws illustrated and described.

Although the elongated beam section 106 with the file 108 are illustrated as having substantially elongated rectangular cube cross-sectional configuration, it should be apparent to those skilled in the art that the beam 106 with the file 108 may have any cross-section, coarseness, grain, and or texture(s), such as a 4-way multi-function file 108 that has four different coarseness, grain, and or texture(s) on one or more sides. FIG. 1B is an exemplary illustration of only a few non-limiting examples of different types of elongated beams 106 with file 108 that may be used as an integral part of any of the hacksaws disclosed, in accordance with the present invention. Therefore, different files can be swapped out as the beam to increase the number of possible uses.

Figure 2A:
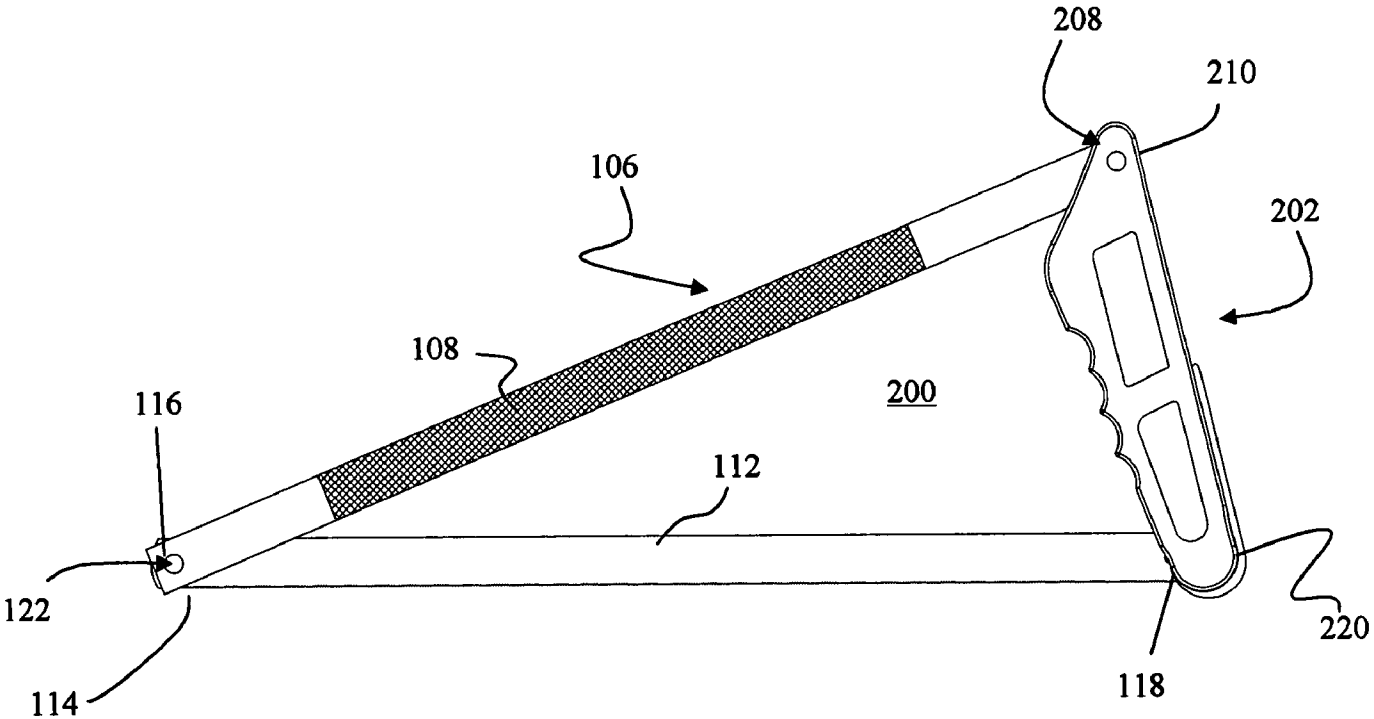
FIG. 2A is an exemplary illustration of an assembled, detachable three-sided hacksaw with a file as an integral part of the frame of the hacksaw in accordance with the present invention.
Figure 2B:
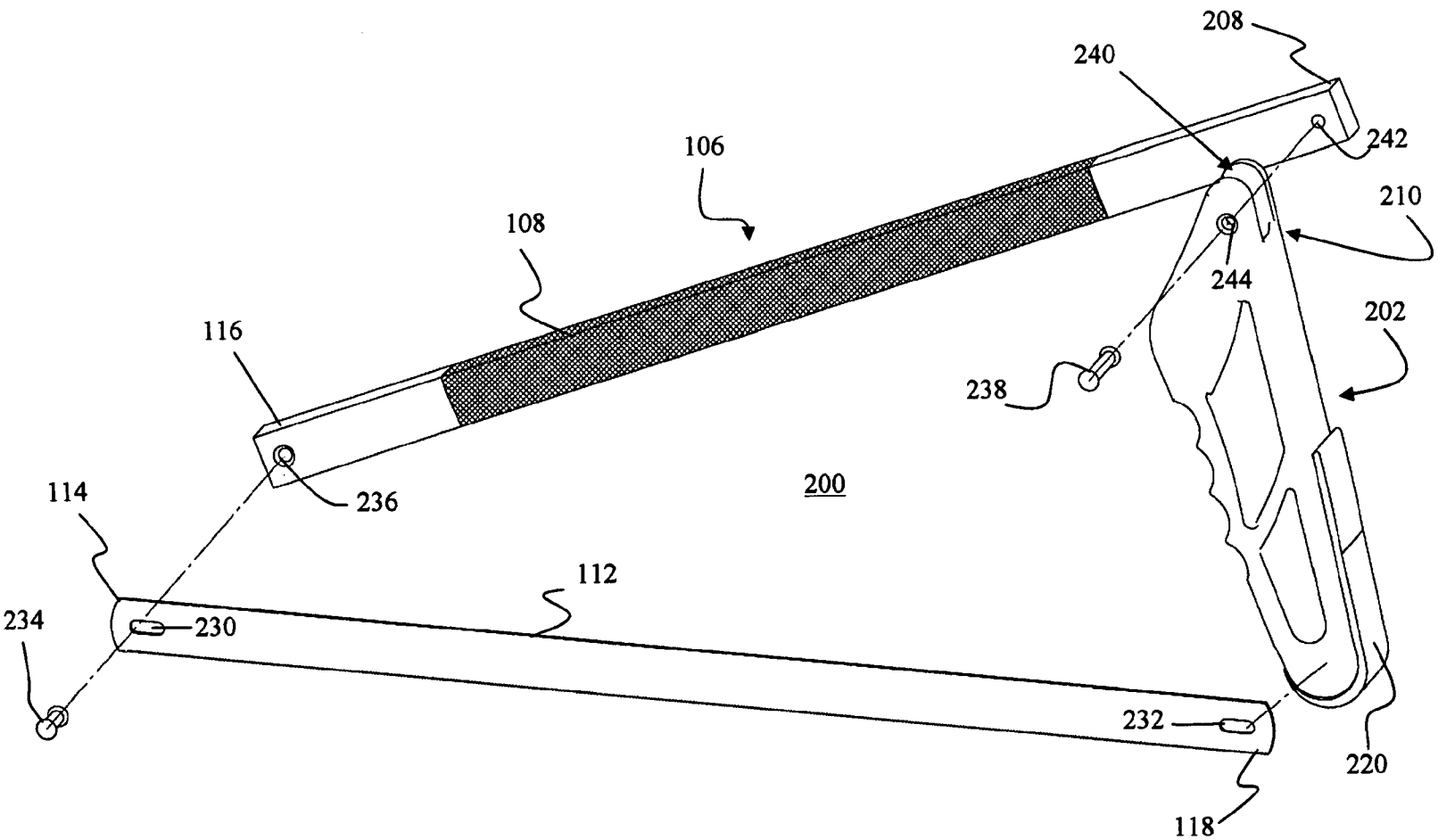
FIG. 2B is an exemplary illustration of the disassembled hacksaw illustrated in FIG. 2A in accordance with the present invention.

FIGS. 2A and 2B are exemplary illustration of another embodiment for a hacksaw with a detectable file as an integral part of the hacksaw frame in accordance with the present invention. The hacksaw 200 includes similar corresponding or equivalent components as the hacksaw 100 that is shown in FIGS. 1A and 1B, and described above. Therefore, for the sake of brevity, clarity, convenience, and to avoid duplication, the general description of FIGS. 2A and 2B will not repeat every corresponding or equivalent component that has already been described above in relation to hacksaw 100.

As illustrated in FIG. 2A, the present invention provides a hacksaw 200 comprising a structure having a frame that includes a back handle 202 and a detachable, elongated beam 106. The elongated beam 106 or file 108 has a first distal end 208 coupled with a first back handle section 210, and a second distal end 116 coupled with a first end 114 of a hacksaw blade 112. A second end of the hacksaw blade 118 is coupled with a second back handle section 220. The benefit of providing a detectable elongated beam 106 comprised of the file 108 is that the file 108 may be separated from the frame of the hacksaw 200, and used in a conventional manner.

As further illustrated in FIG. 2B, the first back handle section 210 includes a receiving channel 240 for detachably and securely coupling the first distal end 208 of the elongated beam 106 therewith. The structure of the receiving channel 240 may be configured commensurate with the cross-sectional form of the first distal end 208 of the elongated beam 106 that connects therewith, and hence, should not be limited to the illustrated configuration. The mechanism for securing the elongated beam 106 with the first back handle section 210 may take any form, a non-limiting example of which may include simple fasteners 238, for example, screws, bolts, etc. The first distal end 208 of the elongated beam 106 is inserted into the receiving channel 240, with the first distal end aperture 242 of the elongated beam 106 aligned with the lateral apertures 244 of the receiving channel 240. This allows the fastener 238 to be inserted (illustrated by the dashed lines) through the lateral apertures 244 and the first distal end aperture 242, thereby securing the elongated beam 106 to the back handle 202.

The second distal end 116 of the elongated beam 106 includes an aperture 236 that is aligned with a first end aperture 230 of the first end 114 of the hacksaw blade 112. This allows a fastener 234 to be inserted through both apertures 230 and 236, which forms the connection mechanism 122, thereby securing the elongated beam 106 to the first end 114 of the hacksaw blade 112. The connection of the second end 118 of the hacksaw blade 112 with the second back handle section 220 is through an aperture 232 provided on the hacksaw blade 112 that is inserted onto a pin type protuberance 308 (illustrated in FIG. 3B) in a conventional and well known manner, and may further include any type of well-known blade tensioning mechanism 410 (first illustrated in FIG. 4A).

Figure 3A:
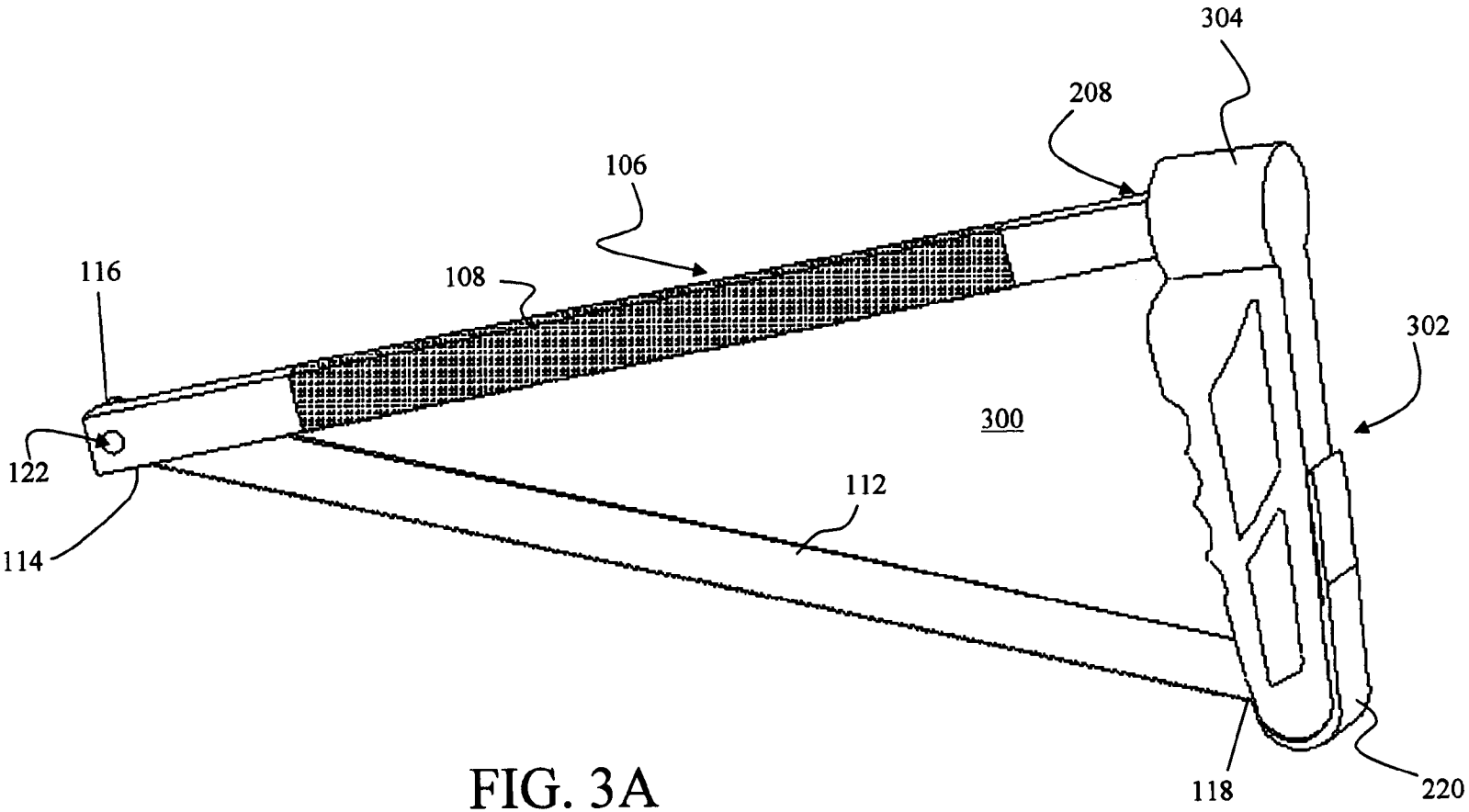
FIG. 3A is an exemplary illustration of another embodiment for an assembled, detachable three-sided hacksaw with a file as an integral part of the frame of the hacksaw in accordance with the present invention.
Figure 3B:
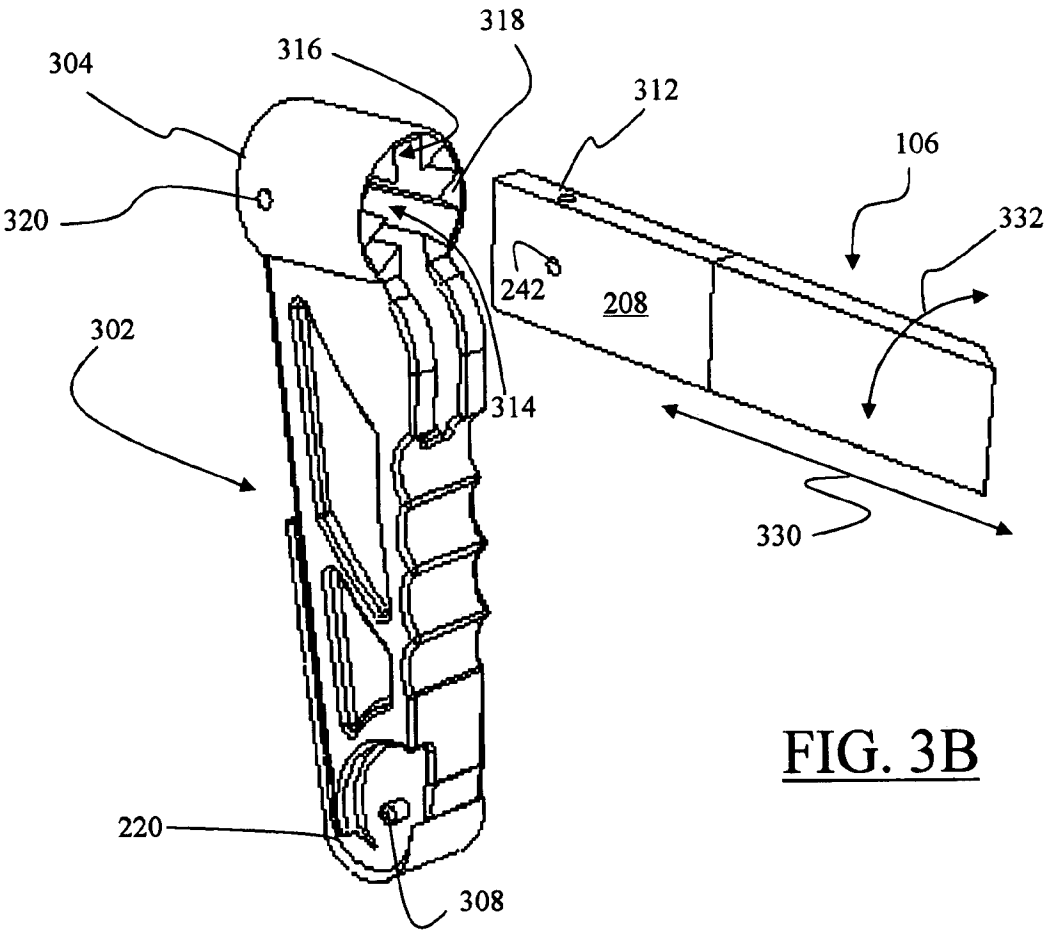
FIG. 3B is an exemplary illustration of the details of the back handle of the hacksaw of FIG. 3A in accordance with the present invention.

FIGS. 3A and 3B are exemplary illustration of yet another embodiment of a hacksaw 300 with a file as an integral part of the hacksaw frame in accordance with the present invention. The hacksaw 300 includes similar corresponding or equivalent components as those illustrated in FIGS. 1A to 2B, and described above. Therefore, for the sake of brevity, clarity, convenience, and to avoid duplication, the general description of FIGS. 3A and 3B will not repeat every corresponding or equivalent component that has already been described above in relation to hacksaws that are shown in FIGS. 1A to 2B.

As illustrated in FIG. 3A, the hacksaw 300 includes a back handle 302 comprised of a first back handle section 304 that couples with the first distal end 208 of the elongated beam 106. As best illustrated in FIG. 3B, the first back handle section 304 is comprised of a housing 314 that includes a radial array of receiving channels 316 that are configured commensurate with a cross-section of one of the first and the second distal ends 208 and 116 of the file 108. The radial array of the receiving channels 316 are formed by a set of protrusions 318 that are spaced along a radial inner circumference of the housing 314. Although the protrusions 318 are illustrated as having triangular cross-section, any cross-sectional configuration that allows for a radial array of receiving channels 316 to be commensurately configured with the cross-section of one of the first and the second distal ends 208 and 116 of the file 108 would work. In fact, each protrusion of the radial set of protrusions 318 may be configured differently such that one or more of the receiving channels of the radial array of receiving channels 316 that are formed, are configured commensurate with a cross-section of at least one of the first and the second distal ends 208 and 116 of the file 108. In other words, the distal ends 208 and 116 need not be identical, and the radial array of receiving channels 316 need not be identical, so long as at least one or more radial array of receiving channels 316 is commensurately configured to accommodate at least one of the distal ends 208 and 116 of the file 108.

As further illustrated in FIG. 3B, one of the ends of the first and second distal ends 208 and 116 of the beam 106 is inserted into the housing 314 along a longitudinal axis 330 of the file 108, within one of the radial array of receiving channels 316. The radial array of receiving channels 316 would allow the elongated beam 106 to be rotated transverse 332 the longitudinal axis 330, and be detachably and securely coupled with the back handle 302 by fasteners inserted through a set of apertures 320 and one of the apertures 242 and 312 of the file 108, aligned during assembly. As with hacksaw 200, the benefit of providing a detectable elongated beam 106 comprised of the file 108 is that the file 108 may be separated from the frame of the hacksaw 300, and used in a conventional manner. In addition, the file 108 may be tilted to any orientation and detachably secured to the back handle 302, allowing a greater control over the file 108 when used. That is, the user may securely grip the back handle 302 in an orientation that is convenient for the user while the file 108 is securely attached in a different orientation that is best suited for use. This way, the user need not change the natural position or orientation of gripping the back handle 302 to file, rather, it is the file that is tilted and securely attached to the back handle 302 in an orientation that is best suited for the user.

Figure 4A:
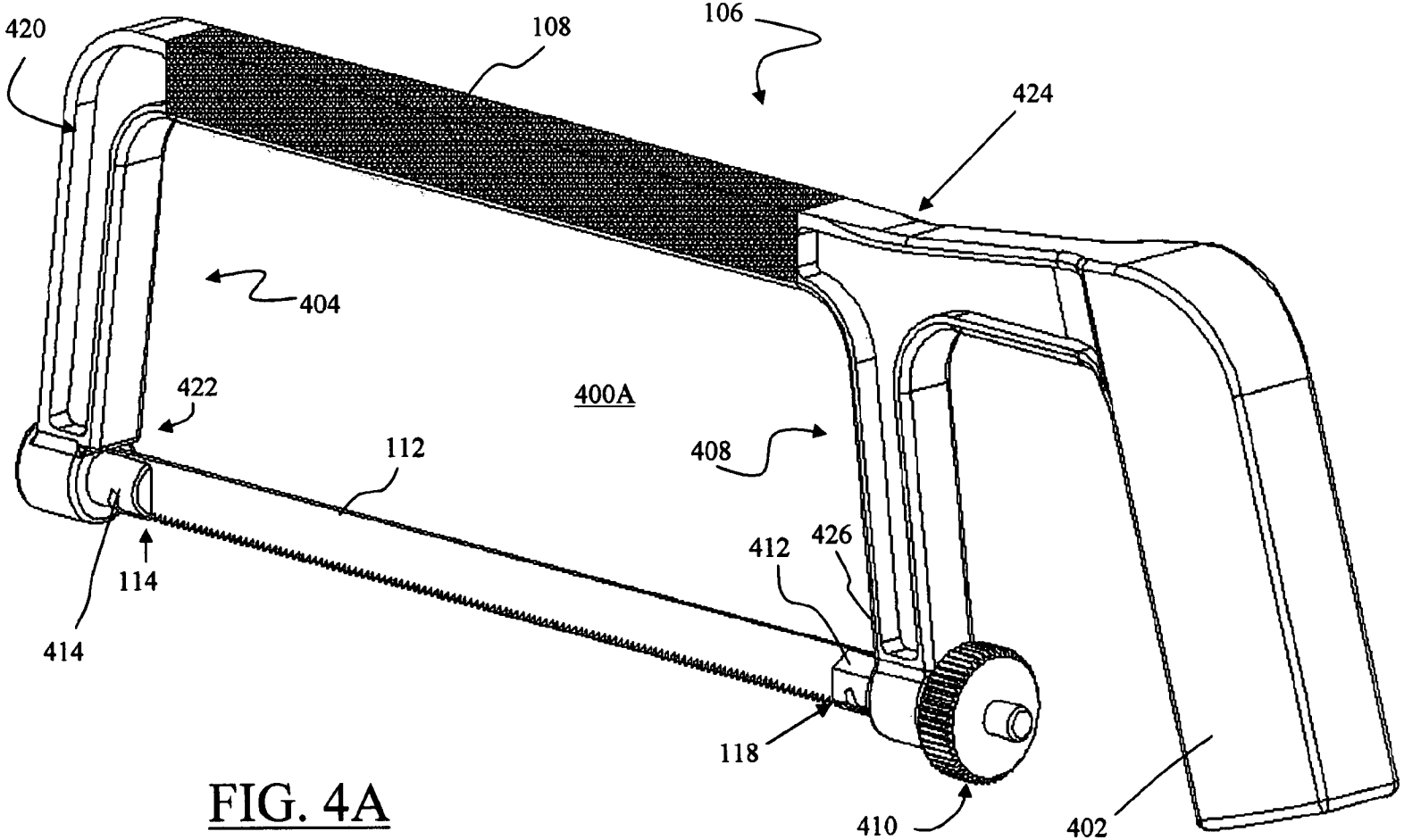
FIGS. 4A and 4B are exemplary illustrations of a single piece, four-sided hacksaws with different frame designs with a file as an integral part of the hacksaw frame in accordance with the present invention.
Figure 4B:
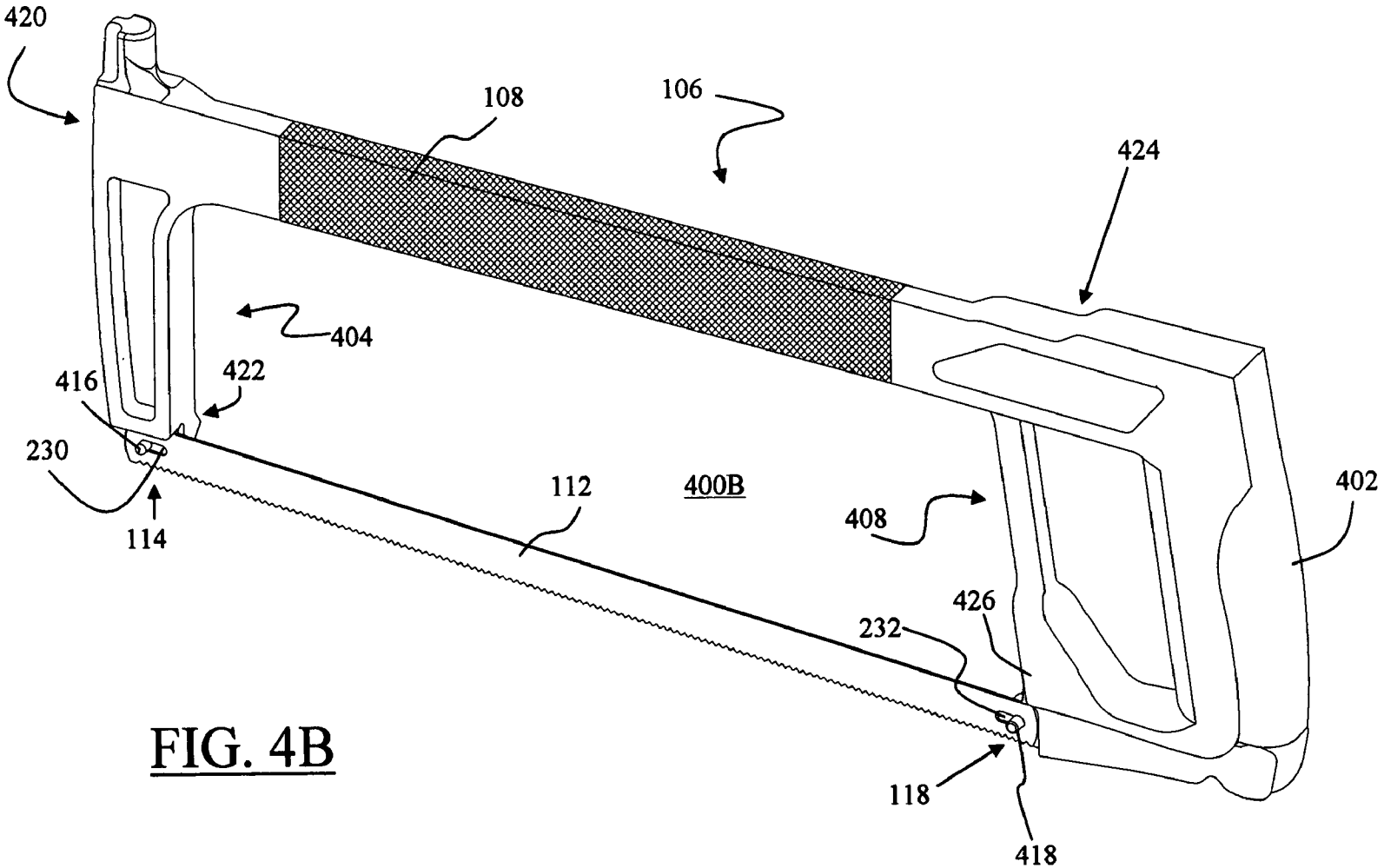

FIGS. 4A and 4B are exemplary illustrations of a further embodiment of respective hacksaws 400A and 400B with different frame designs with a file as an integral part of the hacksaw frame in accordance with the present invention. The hacksaws 400A and 400B include similar corresponding or equivalent components as those illustrated in FIGS. 1A to 3B, and described above. Therefore, for the sake of brevity, clarity, convenience, and to avoid duplication, the general description of FIGS. 4A and 4B will not repeat every corresponding or equivalent component that has already been described above in relation to hacksaws that are shown in FIGS. 1A to 3B.

As illustrated, the hacksaws 400A and 400B in both respective FIGS. 4A and 4B are comprised of a structure having a single piece frame, which is comprised of a back handle section 402 and an elongated beam section 106. As further illustrated in FIGS. 4A and 4B, the structure of the respective hacksaws 400A and 400B further includes a fore piece 404, with the file 108 coupled in between the fore piece 404 and the back handle 402 and a back piece 408 that is parallel with the back handle 402.

As further illustrated, the fore piece 404 of the hacksaws 400A and 400B includes a first front section 420, where the file 108 is coupled in between the first front section 420 and the first back handle section 424. The hacksaws 400A and 400B further include a hacksaw blade 112 with a first end 114 coupled with a second front section 422 of the fore piece 404, and a second end 118 coupled with a lower section 426 of the back piece 408. The mechanism for connection of the first end 114 of the hacksaw blade 112 with the second front section 422 is conventional and well-known, non-limiting example of which may include simple fasteners, for example, screws, bolts with wing nuts, etc. The connection mechanism for the second end 118 of the hacksaw blade 112 with the lower section 426 of the back piece 408 is also conventional and well known, and may further include any type of well-known blade tensioning mechanism 410.

In particular, as best illustrated in FIG. 4A for hacksaw 400A, the connection mechanism 414 securely couples the first end 114 of the hacksaw blade 112 to the second front section 422 of the fore piece 404, and a similar connection mechanism 412 is used to couple the second end 118 of the hacksaw blade 112 to the lower section of the back piece 408. As illustrated in FIG. 4B, for hacksaw 400B the connection of the first and second ends 114 and 118 of the hacksaw blade 112 with the frame of the hacksaw 400B is through respective apertures 230 and 232 provided on the hacksaw blade 112 that is inserted onto respective pin type protuberances 416 and 418 in a conventional and well known manner, and may further include any type of well-known blade tensioning mechanism (not shown in FIG. 4B). The hacksaws 400A and 400B provide the added benefit of a fore piece 404, which allows users a more secure grip of the hacksaw frame by both hands during both cutting and file processes.

FIGS. 5A to 5D are exemplary illustrations of a still further embodiment of a hacksaw 500 with a frame design having a file as an integral part of the hacksaw frame in accordance with the present invention. The hacksaw 500 includes similar corresponding or equivalent components as those illustrated in FIGS. 1A to 4B, and described above. Therefore, for the sake of brevity, clarity, convenience, and to avoid duplication the general description of FIGS. 5A to 5D will not repeat every corresponding or equivalent component that has already been described above in relation to hacksaws that are shown in FIGS. 1A to 4B.

Figure 5A:
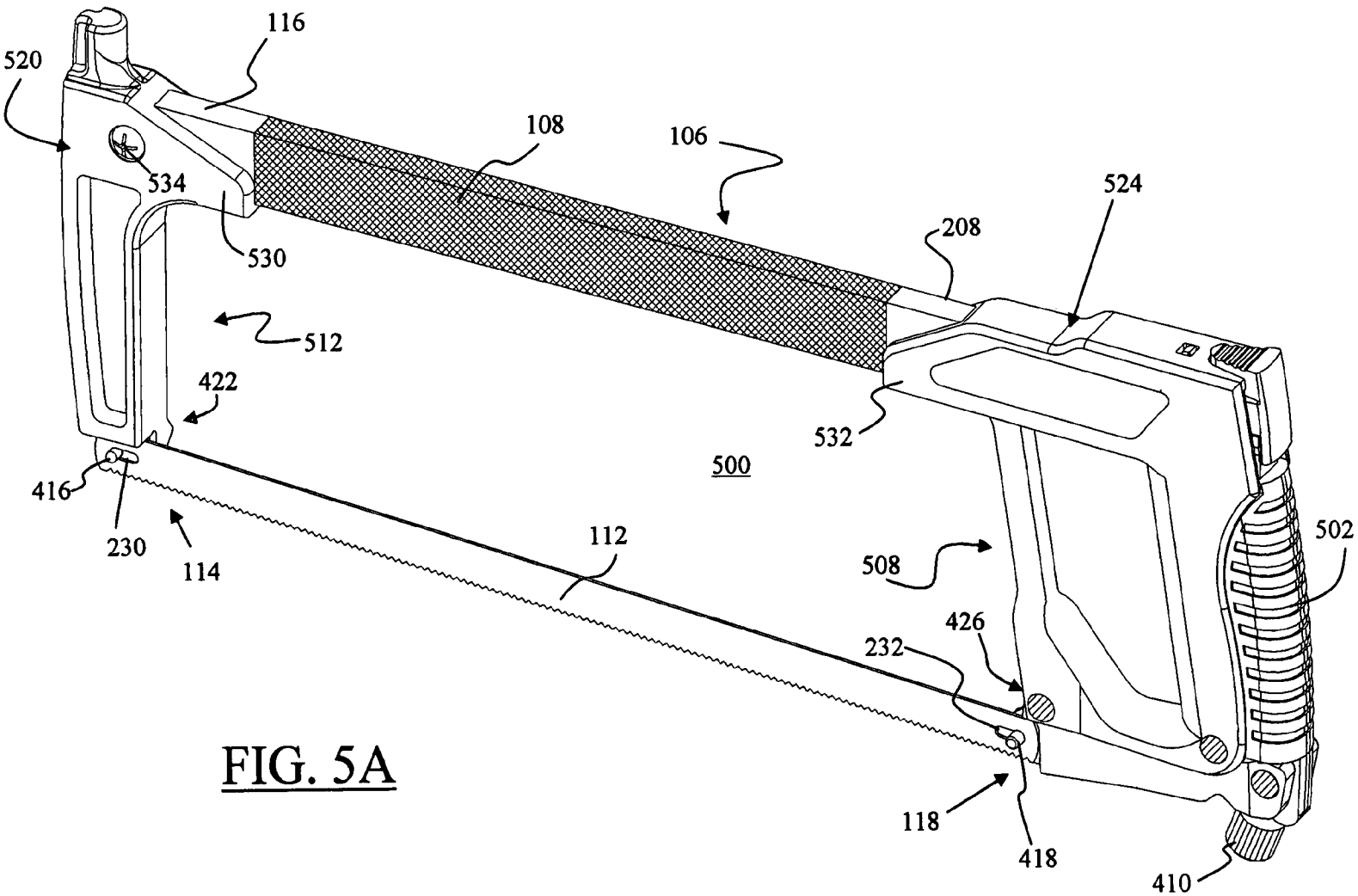
FIGS. 5A to 5D are exemplary illustrations of a detachable four-sided hacksaw with a file as an integral part of the hacksaw frame in accordance with the present invention.

As illustrated in FIG. 5A, the present invention provides a hacksaw 500 comprising a structure having a frame that includes a back handle 502 and a detachable, elongated beam 106 that is coupled to a fore piece 512. The elongated beam 106 or file 108 has a first distal end 208 coupled with a first back handle section 524, and a second distal end 116 coupled with a first front section 520. In addition, a hacksaw blade 112 is provided having the first end 114 coupled with a second front section 422 of the fore piece 512, and a second end 118 coupled with the lower section of a back piece 508. As with the three-sided hacksaw 200, the benefit of providing a detectable elongated beam 106 comprised of the file 108 for the illustrated four-sided hacksaw 500 is that the file 108 may be separated from the frame of the hacksaw 500, and used in a conventional manner.

Figure 5B:
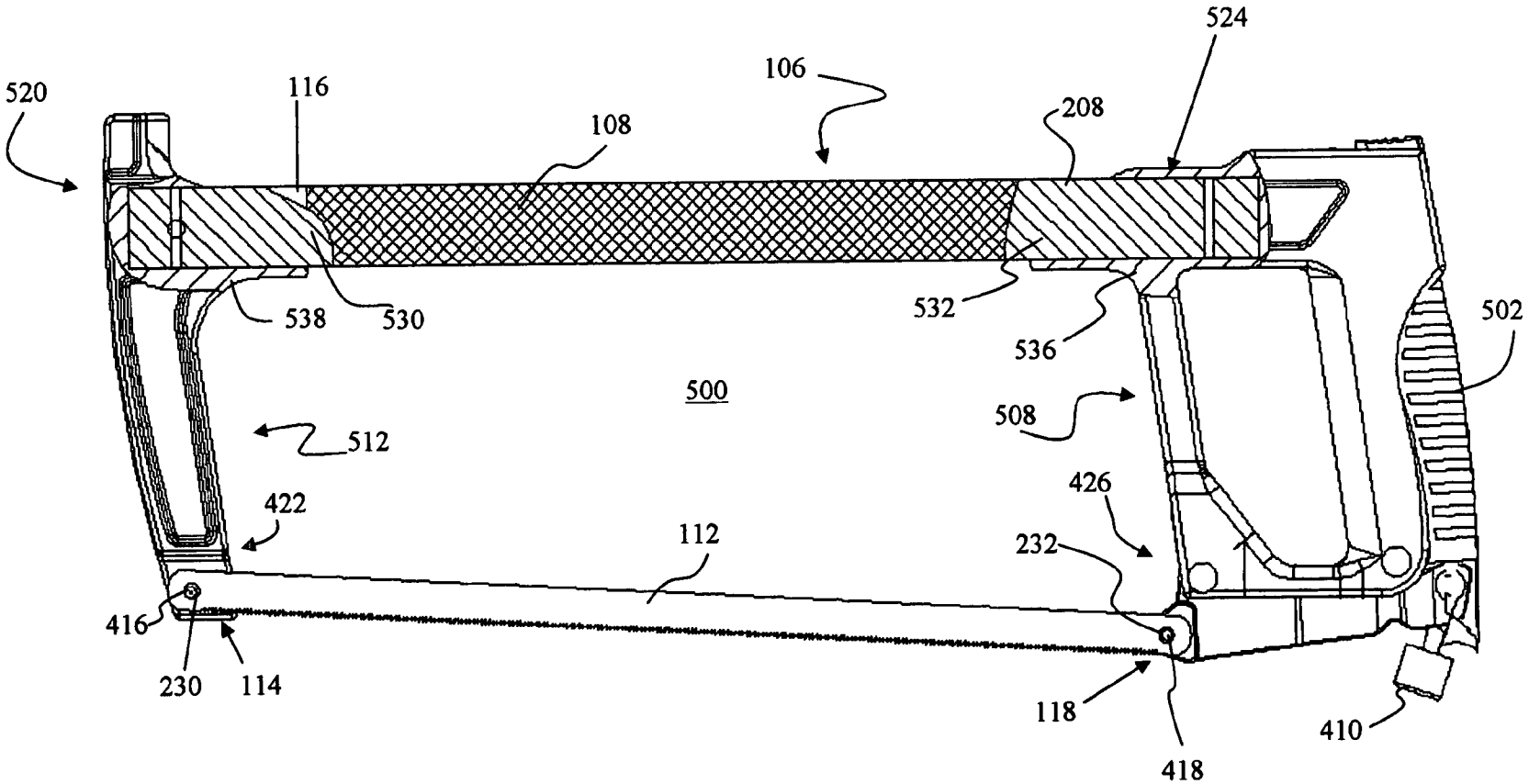
Figure 5C:
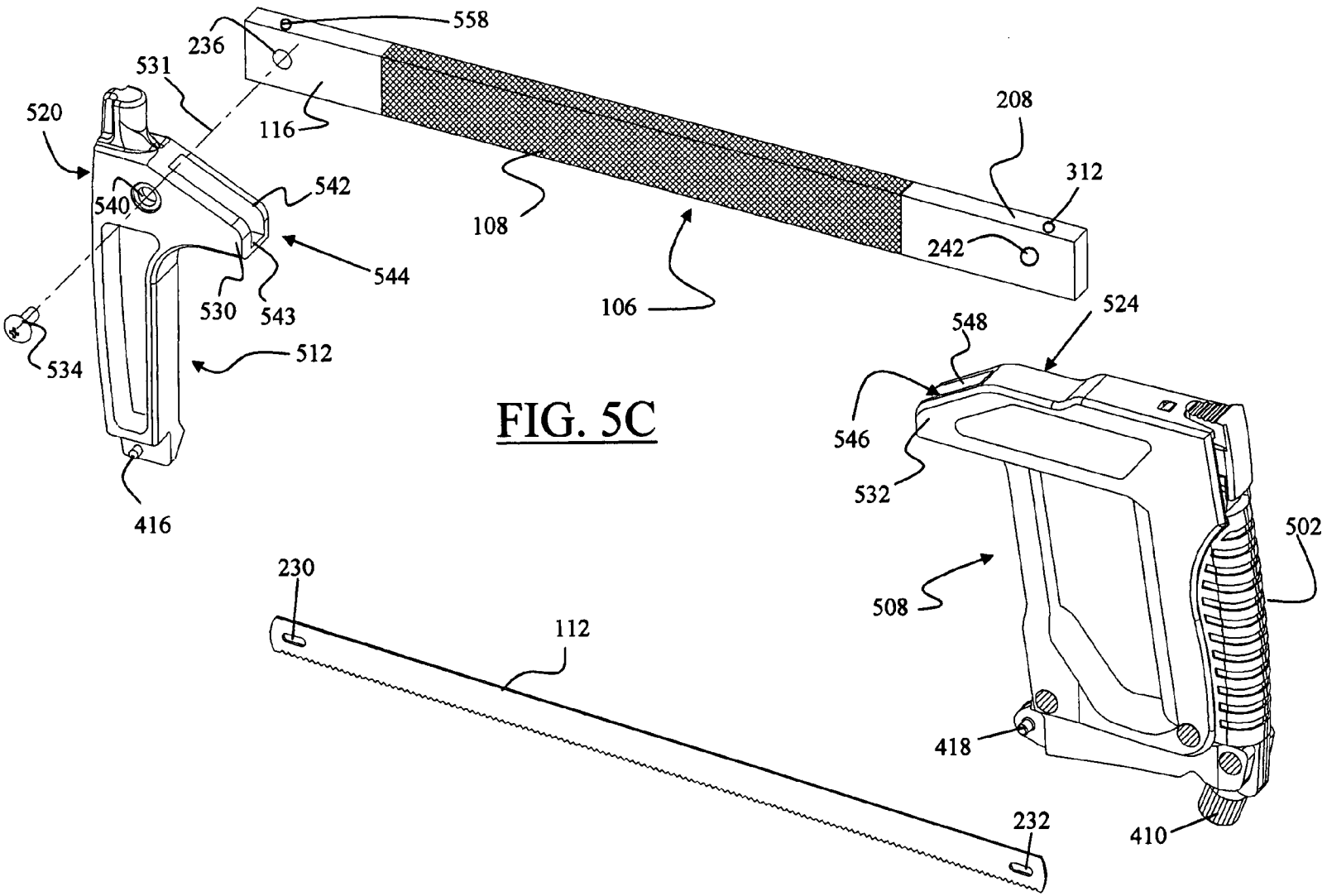
Figure 5D:
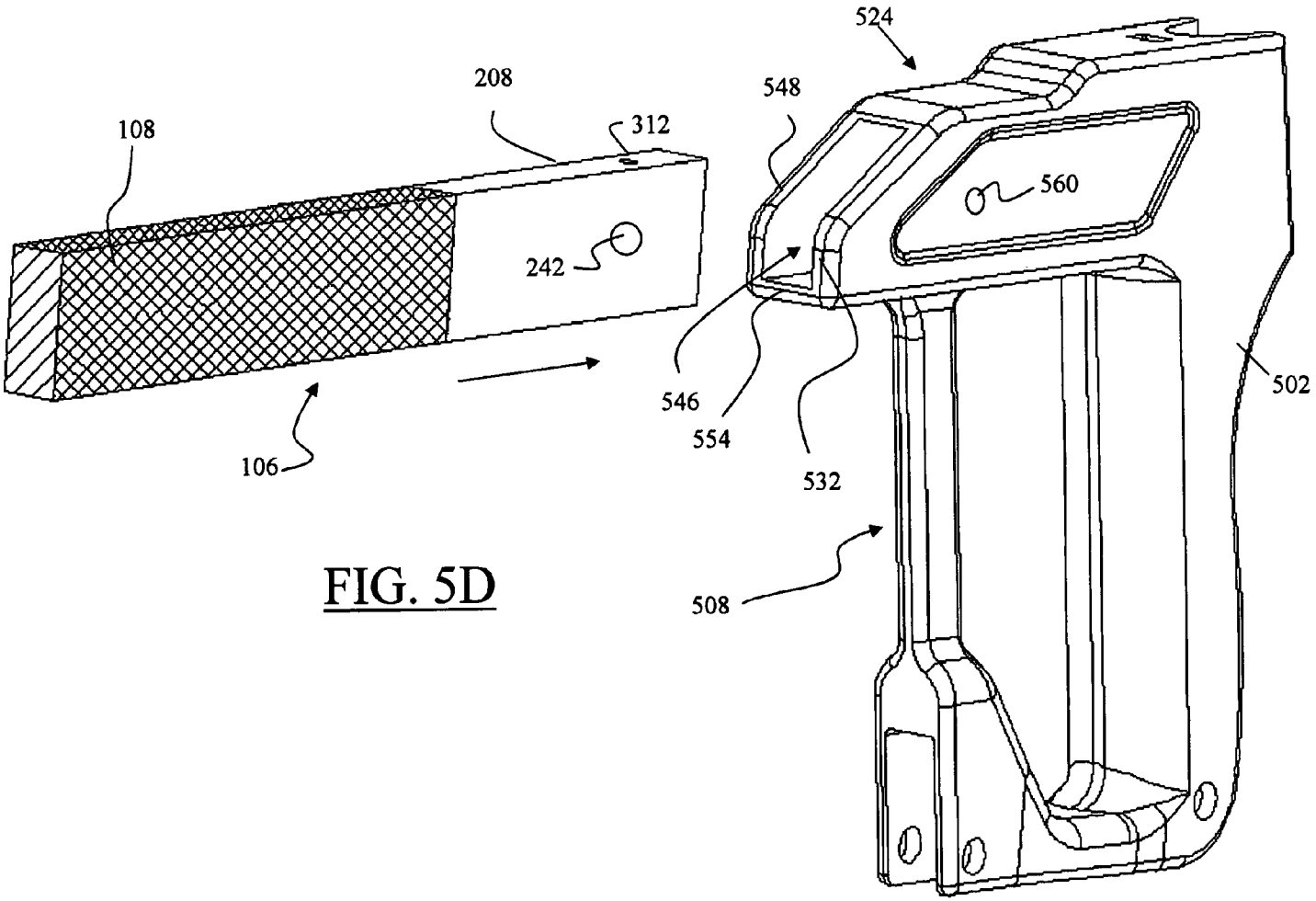

As further illustrated in FIGS. 5A, 5B, and 5C, the first front section 520 of the fore piece 512 is comprised of a fore receiving channel 544 that rest on a support section 538, and is used for detachably and securely coupling of the second distal end 116 of the file 108 with the fore receiving channel 544 of the fore piece 512. The fore receiving channel 544 is comprised of two parallel lateral walls 530 and 542 that are coupled with one another by an bottom side 543, with the fore receiving channel 544 configured to accommodate the exemplary illustrated second distal end 116 of the elongated beam 106. The structure of the fore receiving channel 544 may be configured commensurate with the cross-sectional form of one of the first and second distal ends 208 and 116 of the elongated beam 106 that connects therewith, and hence, should not be limited to the illustrated configuration. The mechanism for securing the elongated beam 106 with the first front section 520 may take any form, a non-limiting example of which may include simple fasteners 534, for example, screws, bolts, etc. One of the first and the second distal end 208 and 116 of the elongated beam 106 is inserted into the fore receiving channel 544, with one of the first and the second distal end apertures 242, 312, and 236, 558 of the elongated beam 106 aligned with the lateral apertures 540 of the fore receiving channel 544. This allows the fastener 534 to be inserted (illustrated by the dashed line 531) through the lateral apertures 540 and one of the first and the second distal end apertures 242, 312, and 236, 558, thereby securing the elongated beam 106 to the fore piece 512.

As best illustrated in FIGS. 5A to 5D, the first back handle section 524 includes an aft receiving channel 546 for detachably and securely coupling the exemplary illustrated first distal end 208 of the elongated beam 106 therewith. The first back handle section 524 is comprised of the aft receiving channel 546 that rest on a support section 536 (as part of the back handle 502), and is used for detachably and securely coupling of the exemplary illustrated first distal end 208 of the file 108 with the aft receiving channel 546. The aft receiving channel 546 is comprised of two parallel lateral walls 532 and 548 that are coupled with one another by a bottom side 554, with the aft receiving channel 546 configured to accommodate one of the first and second distal ends 208 and 116 of the elongated beam 106. The structure of the aft receiving channel 546 may be configured commensurate with the cross-sectional form of one of the first and the second distal ends 208 and 116 of the elongated beam 106 that connects therewith, and hence, should not be limited to the illustrated configuration. The mechanism for securing the elongated beam 106 with the first back handle section 524 may take any form, a non-limiting example of which may include simple fasteners, for example, screws, bolts, etc. One of the first and second distal ends 208 and 116 of the elongated beam 106 is inserted into the aft receiving channel 546, with one of the first and second distal end apertures 242, 312, and 236, 558 of the elongated beam 106 aligned with the lateral apertures 560 of the aft receiving channel 546. This allows the fastener to be inserted through the lateral apertures 560 and the first and the second distal end apertures 242, 312, and 236, 558, thereby securing the elongated beam 106 to the back handle 502. The hacksaw 500 provides the added benefit of a fore piece 512, which allows users a more secure and controlled grip of the hacksaw frame by both hands during both cutting and file processes.

Figure 6A:
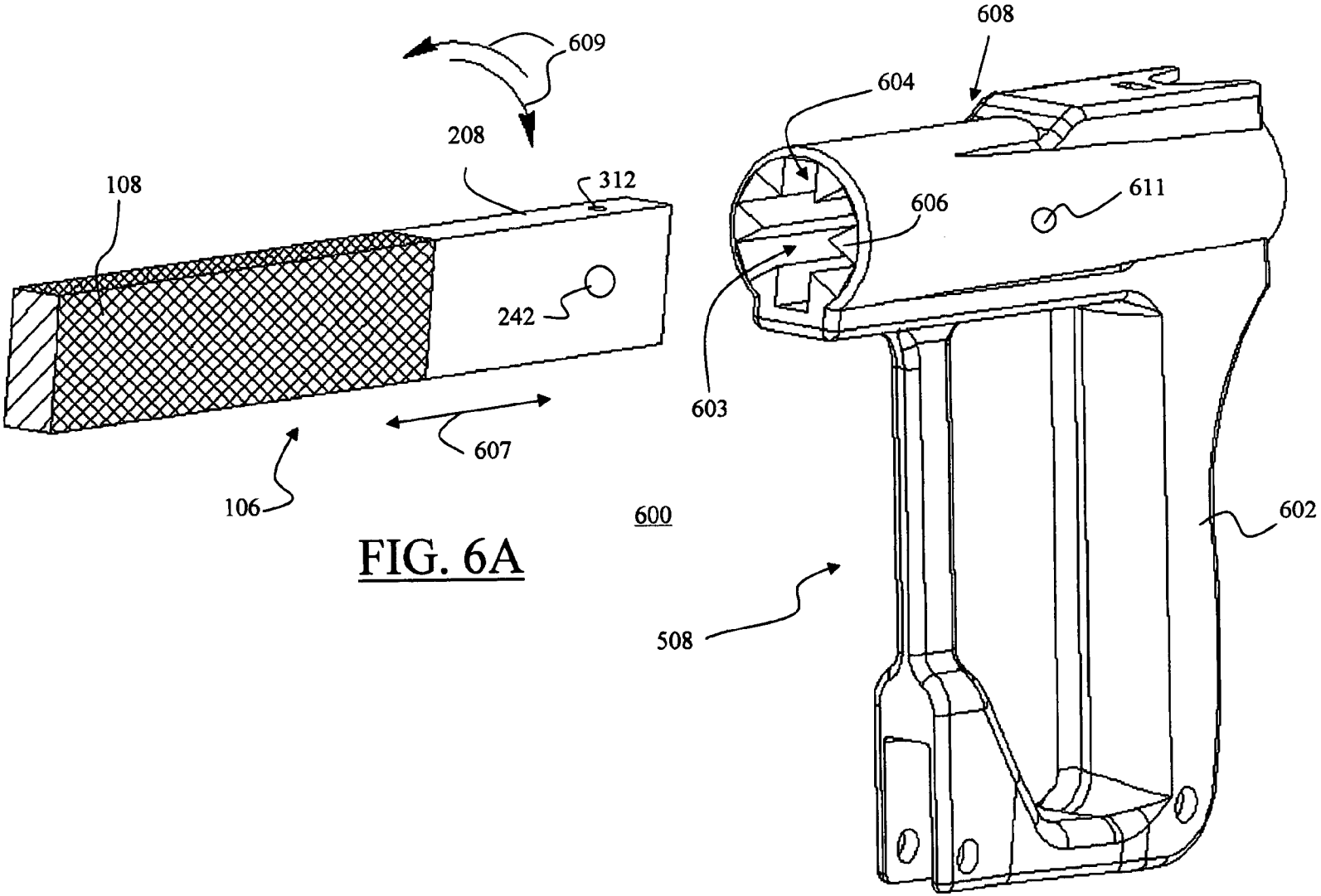
FIGS. 6A to 6B are exemplary illustrations of another embodiment for a detachable four-sided hacksaw with a file as an integral part of the hacksaw frame in accordance with the present invention.
Figure 6B:
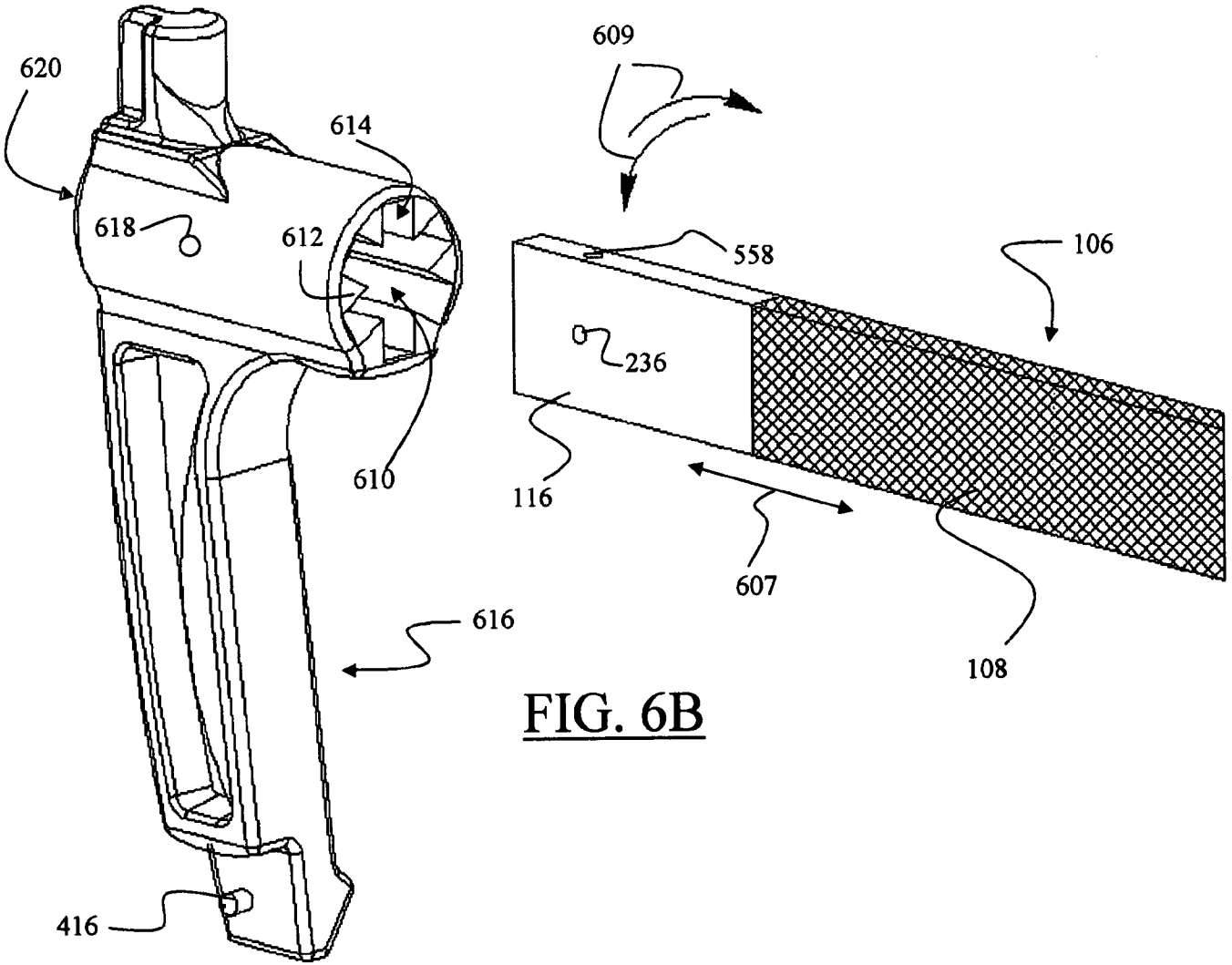

FIGS. 6A to 6B are exemplary illustrations of a still further embodiment of a hacksaw 600 with a frame design having a file as an integral part of the hacksaw frame in accordance with the present invention. The hacksaw 600 includes similar corresponding or equivalent components as those illustrated in FIGS. 1A to 5D, and described above. Therefore, for the sake of brevity, clarity, convenience, and to avoid duplication the general description of FIGS. 6A to 6B will not repeat every corresponding or equivalent component that has already been described above in relation to hacksaws that are shown in FIGS. 1A to 5D.

As illustrated in FIG. 6A, the hacksaw 600 includes a back handle 602 comprised of a first back handle section 608 that couples with the first distal end 208 of the elongated beam 106. The first back handle section 608 is comprised of a housing 603 that includes radial array of receiving channels 604 that are configured commensurate with a cross-section of one of the first and the second distal ends 208 and 116 of the file 108. The radial array of the receiving channels 604 are formed by a set of protrusions 606 that are spaced along a radial inner circumference of the housing 603. Although the protrusions 606 are illustrated as having triangular cross-section, any cross-sectional configuration that allows for a radial array of receiving channels 604 to be commensurately configured with the cross-section of one of the first and the second distal ends 208 and 116 of the file 108 would work. In fact, each protrusion 606 of the radial set of protrusions may be configured differently such that one or more of the receiving channels of the radial array of receiving channels 604 that are formed, are configured commensurate with a cross-section of at least one of the first and the second distal ends 208 and 116 of the file 108. In other words, the distal ends 208 and 116 need not be identical, and the radial array of receiving channels 604 need not be identical, so long as at least one or more receiving channels of the radial array of receiving channels 604 is commensurately configured to accommodate at least one of the distal ends 208 and 116 of the file 108.

As further illustrated in FIG. 6A, one of the ends of the first and second distal ends 208 and 116 is inserted into one of the receiving channels of the array of receiving channels 604 along a longitudinal axis 607 of the file 108. The radial array of receiving channels 604 would allow the elongated beam 106 to be rotated transverse 609 the longitudinal axis 607, and be detachably and securely coupled with the back handle 602 by fasteners inserted through a set of apertures 611 and one of the first and the second distal end apertures 242, 312, 236, and 558 aligned during assembly. The benefit of providing a detectable elongated beam 106 comprised of the file 108 is that the file 108 may be separated from the frame of the hacksaw 600, and used in a conventional manner. In addition, the file 108 may be tilted to any orientation and detachably secured to the back handle 602, allowing a greater control over the file 108 when used. That is, the user may securely grip the back handle 602 in an orientation that is convenient for the user while the file 108 is securely attached in an orientation that is best suited for use. This way, the user need not change the natural position or orientation of gripping the back handle 602 to file, rather, it is the file that is tilted and securely attached to the back handle 602 in an orientation that is best suited for the user.

As best illustrated in FIG. 6B, the hacksaw 600 includes a fore piece 616 that is comprised of a first front section 620 that couples with the second distal end 116 of the elongated beam 106. The first front section 620 of the fore piece 616 is comprised of a housing 610 having a radial array of receiving channels 614 that are configured commensurate with a cross-section of one of the first and the second distal ends 208 and 116 of the file 108. The radial array of the receiving channels 614 are formed by a set of protrusions 612 that are spaced along a radial inner circumference of the receiving channel 610. Although the protrusions 612 are illustrated as having triangular cross-section, any cross-sectional configuration that allows for a radial array of receiving channels 614 to be commensurately configured with the cross-section of one of the first and the second distal ends 208 and 116 of the file 108 would work. In fact, each protrusion of the radial set of protrusions 612 may be configured differently such that one or more of the receiving channels 614 that are formed, are configured commensurate with a cross-section of at least one of the first and the second distal ends 208 and 116 of the file 108. In other words, the distal ends 208 and 116 need not be identical, and the radial array of receiving channels 614 need not be identical, so long as at least one or more receiving channels 614 is commensurately configured to accommodate at least one of the distal ends 208 and 116 of the file 108.

As further illustrated in FIG. 6B, one of the ends of the first and second distal ends 208 and 116 is inserted into one of the receiving channels 614 along a longitudinal axis 607 of the file 108. The radial array of receiving channels 614 would allow the elongated beam 106 to be rotated transverse 609 the longitudinal axis 607, and be detachably and securely coupled with the fore piece 616 by fasteners inserted through a set of apertures 618 and one of the first and second distal end apertures 242, 312, 236, and 558 aligned during assembly. The benefit of providing a detectable elongated beam 106 comprised of the file 108 is that the file 108 may be separated from the frame of the hacksaw 600, and used in a conventional manner. In addition, the file 108 may be tilted to any orientation and detachably secured to the back handle 602, allowing a greater control over the file 108 when used. That is, the user may securely grip the back handle 602 in an orientation that is convenient for the user while the file 108 is securely attached in an orientation that is best suited for use. This way, the user need not change the natural position or orientation of gripping the fore piece 616 to file, rather, it is the file that is tilted and securely attached to the fore piece 616 in an orientation that is best suited for the user.

FIGS. 7A to 7D are exemplary illustrations of a further embodiment of a hacksaw 700 with a frame design having a file as an integral part of the hacksaw frame in accordance with the present invention. The hacksaw 700 includes similar corresponding or equivalent components as those illustrated in FIGS. 1A to 6B, and described above. Therefore, for the sake of brevity, clarity, convenience, and to avoid duplication the general description of FIGS. 7A to 7D will not repeat every corresponding or equivalent component that has already been described above in relation to hacksaws that are shown in FIGS. 1A to 6B.

Figure 7A:
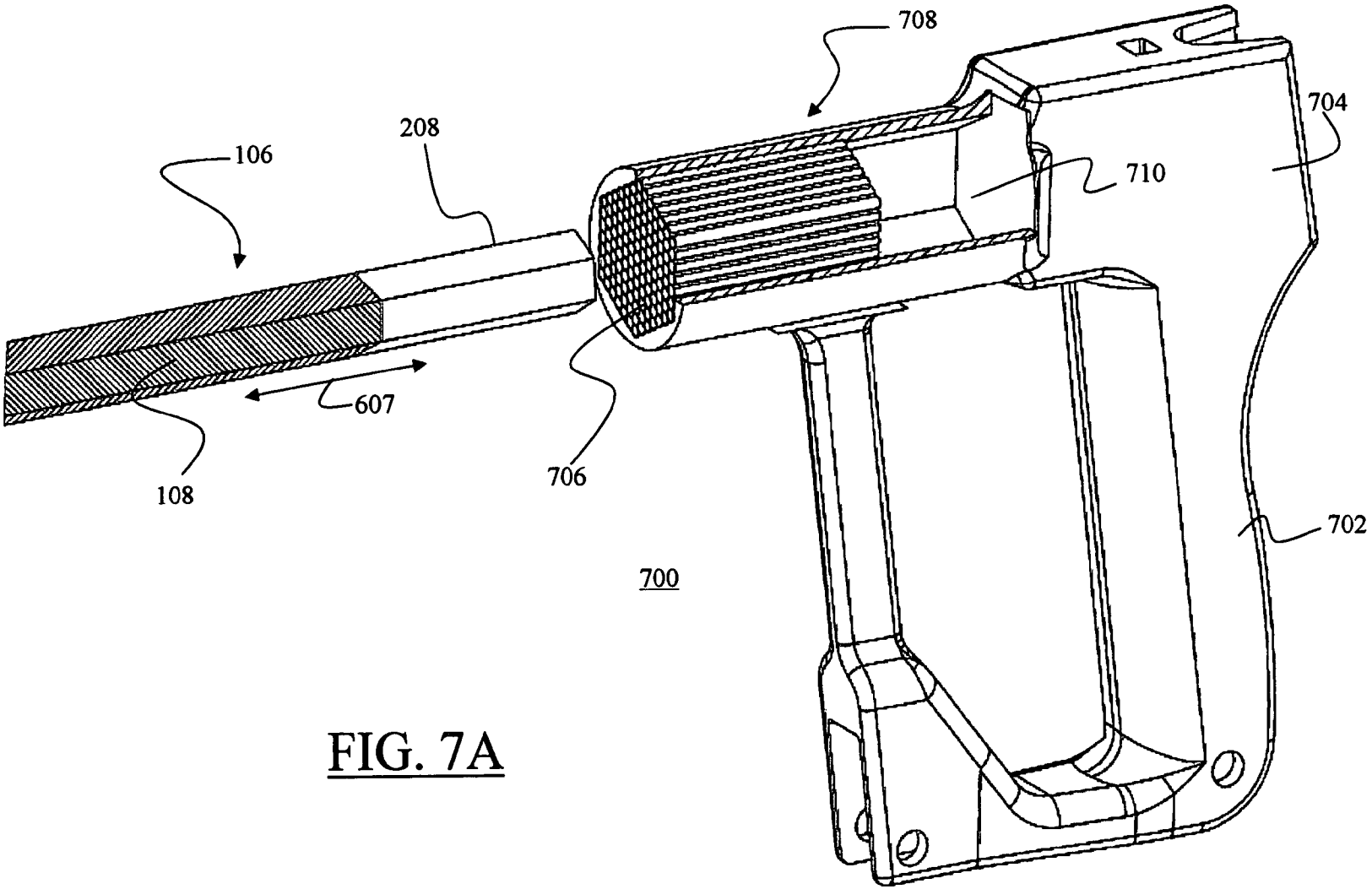
FIGS. 7A to 7D are exemplary illustrations of a further embodiment for a detachable four-sided hacksaw with a file as an integral part of the hacksaw frame in accordance with the present invention.
Figure 7B:
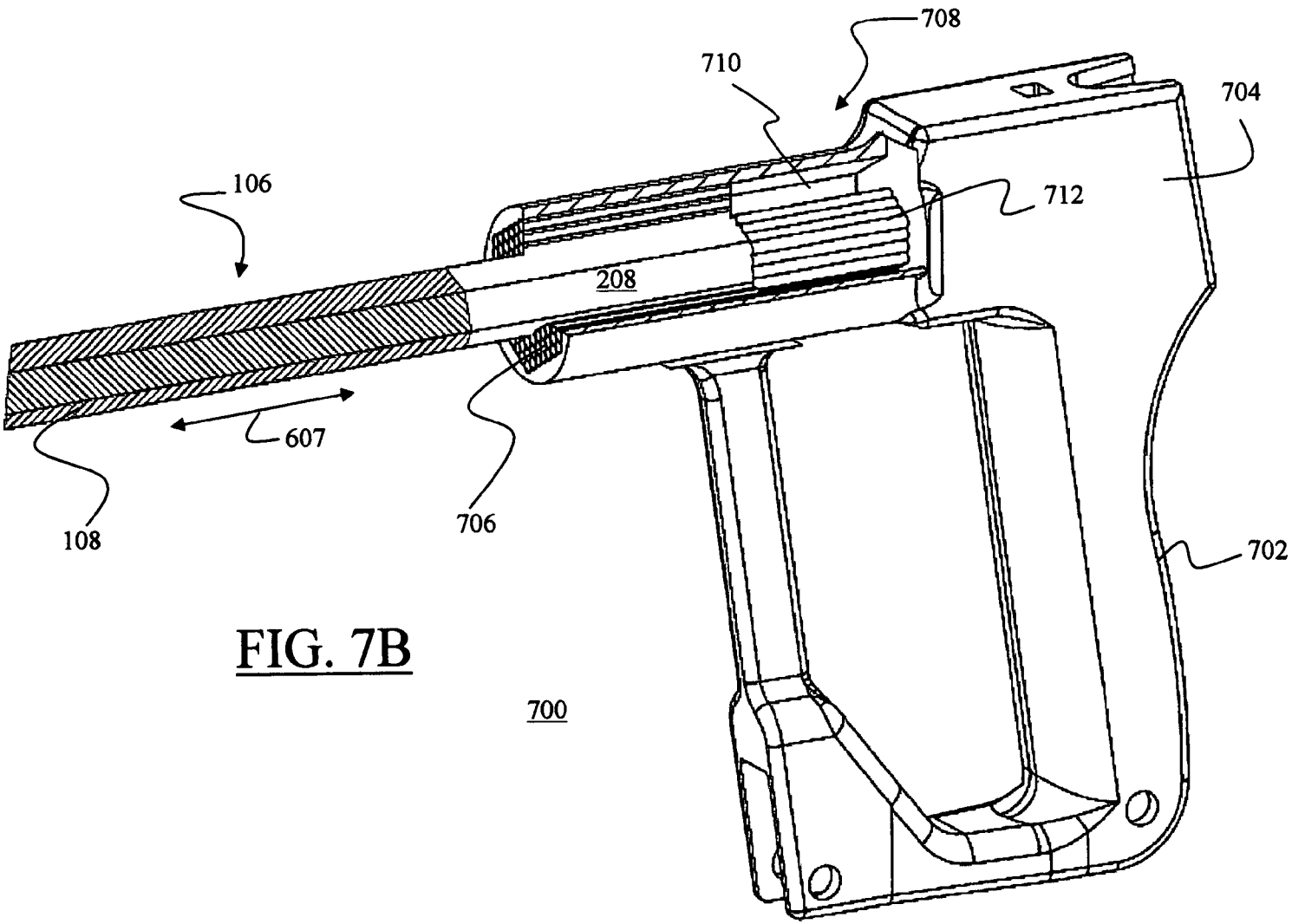

As best illustrated in FIGS. 7A and 7B, the hacksaw 700 includes a back handle 702 comprised of a first back handle section 704 that includes a receiving channel 708 that couples with the first distal end 208 of the elongated beam 106. The receiving channel 708 is comprised of spring loaded pin system having a plurality of retractable pins 706 within a housing 710 that configure to accommodate any shape file. For the sake of clarity and brevity, not all the components of the spring loaded pin system are illustrated. The components, mechanical and the working principle details of such spring loaded pin system illustrated in FIGS. 7A to 7D are well-known, and disclosed in U.S. Pat. No. 5,622,090 to Marks, U.S. Pat. No. 5,791,209 to Marks, and U.S. Pat. No. 6,085,619 to Blake et al, the entire disclosures of all of which patents are expressly incorporated by reference herein. As best illustrated in FIG. 7B, when one of the ends of the first and second distal ends 208 and 116 of the elongated beam 106 is inserted into the receiving channel 708, the transverse lateral edge of the elongated beam (transverse to the longitudinal length of the elongated beam 106) pushes some of the pins 712 back into the housing 710. The remaining non-retract pins 706 surround and lock in the longitudinal lateral edges of the elongated beam as illustrated. The pins 712 retracted into the housing 710 substantially match the cross-section of the elongated beam 106. The benefit of the receiving channel 708 is that any shaped file 108 may be used, and the file 108 may be tilted to any orientation and detachably secured to the back handle 702, allowing a greater control over the file 108 when used.

Figure 7C:
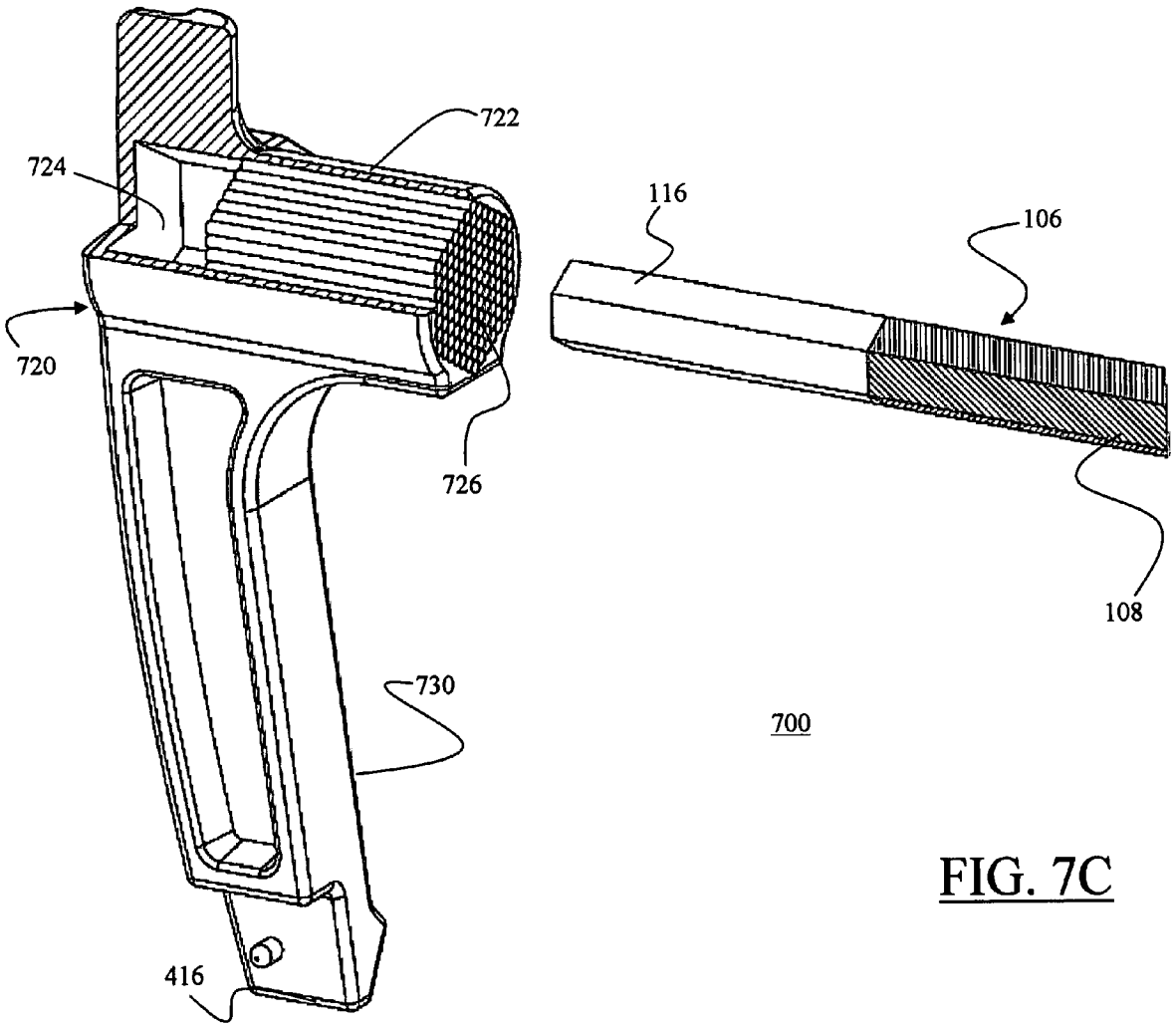
Figure 7D:
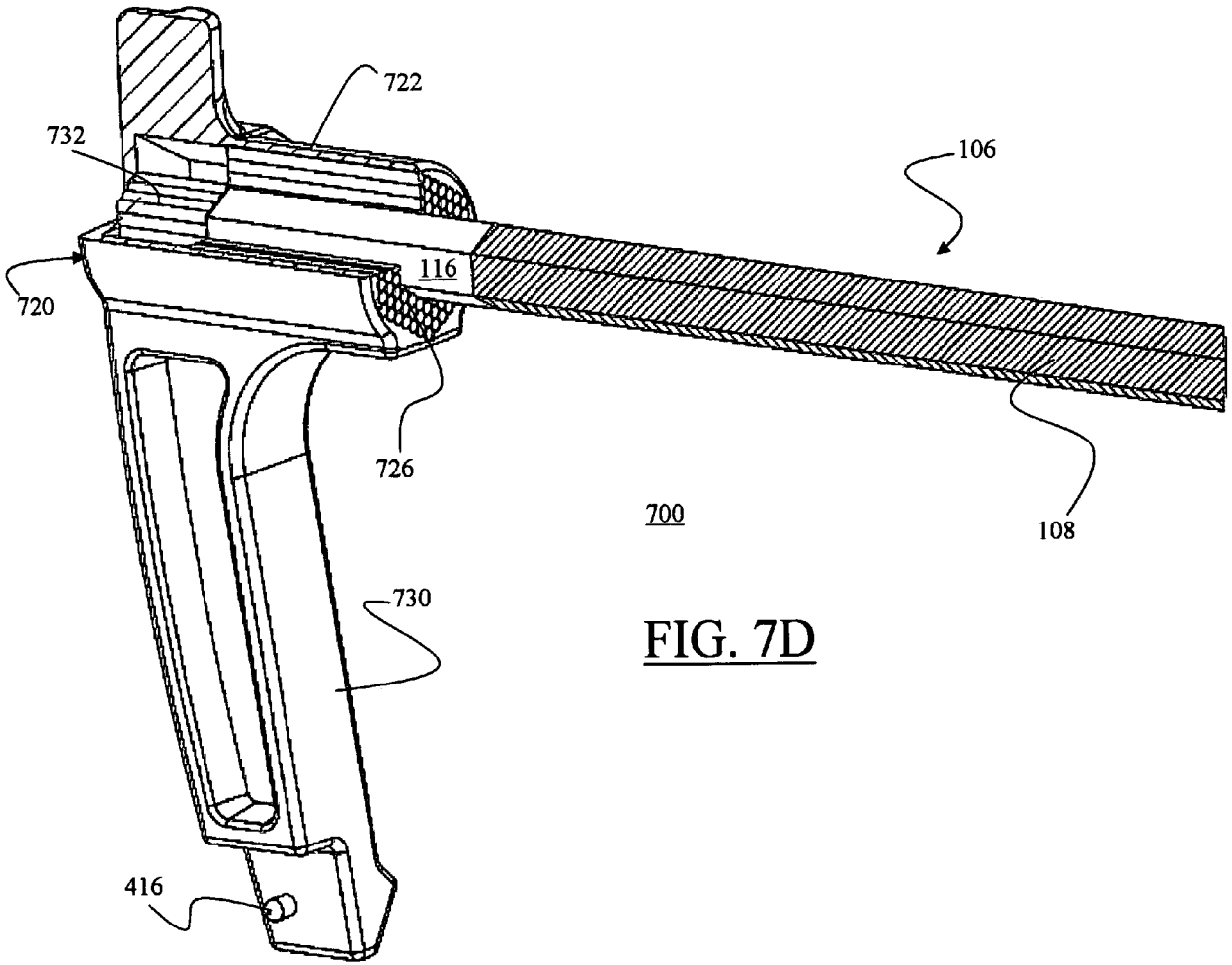

As illustrated in FIGS. 7C and 7D, the hacksaw 700 includes a fore piece 730 that is comprised of a first front section 720 that couples with one of the first and the second distal ends 208 and 116 of the elongated beam 106. As with the first back handle section 704, the first front section 720 of the fore piece 730 includes a receiving channel 722 that includes a spring loaded pin system that is comprised of plurality of retractable pins 726 within a housing 724 that configure to accommodate any shape file. As with FIGS. 7A and 7B, for the sake of clarity and brevity, not all the components of the spring loaded pin system are illustrated.

As best illustrated in FIG. 7D, the receiving channel 722 automatically configures commensurate with a cross-section of any of the distal ends 208 and 116 of the file 108. When one of the distal ends 208 and 116 of the file 108 is inserted into the receiving channel 722, the transverse lateral edge of the elongated beam (transverse to the longitudinal length of the elongated beam 106) pushes some of the pins 732 back into the housing 724. The remaining non-retract pins 726 surround and lock in the longitudinal lateral edges of the elongated beam as illustrated. The cross-sectional configuration of the bundle of pins 732 retracted into the housing 724 substantially match the cross-section of the elongated beam 106.

Figure 8:
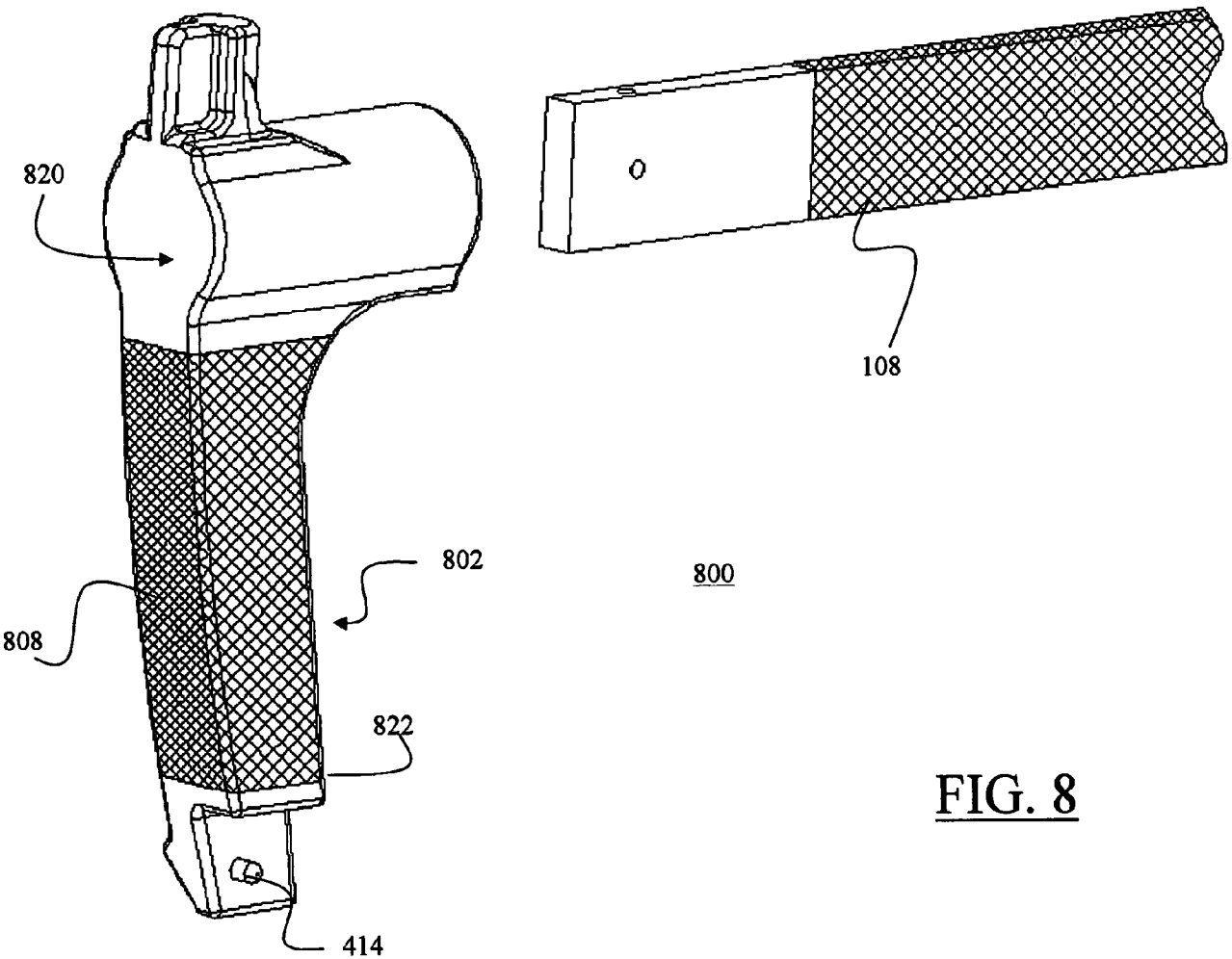
FIG. 8 is an exemplary illustration of yet another embodiment for a detachable four-sided hacksaw with two files as integral part of the hacksaw frame, showing the fore piece thereof in accordance with the present invention.

FIG. 8 is an exemplary illustration of yet another embodiment of a hacksaw 800 with a frame design having at least one file as an integral part of the hacksaw frame in accordance with the present invention. The hacksaw 800 includes similar corresponding or equivalent components as those illustrated in FIGS. 1A to 7D, and described above. Therefore, for the sake of brevity, clarity, convenience, and to avoid duplication the general description of FIG. 8 will not repeat every corresponding or equivalent component that has already been described above in relation to hacksaws that are shown in FIGS. 1A to 7D.

As illustrated in FIG. 8, the fore piece 802 is a beam that has a series of ridges on at least one or more surfaces of the fore piece 802 for reducing and smoothing surfaces of an article, forming a file 808. The fore piece 802 includes a first beam section 820, where the file 108 is coupled in between the first beam section 820 and the first back handle section (illustrated in any of the FIGS. 1A to 7D). As with other embodiments, the hacksaw blade 112 (illustrated in any of the previous FIGS. 1A to 7D) has a first end and a second end, with the first end of the hacksaw blade 112 coupled with a second beam section 822, and the second end of the hacksaw blade 112 is coupled with the second back handle section (illustrated in any of the previous FIGS. 1A to 7D). It should be noted that any of the receiving channels that are described and illustrated in FIGS. 1A to 7D may be used for both the fore piece 802 and the back handle section of this embodiment.

Figure 9:
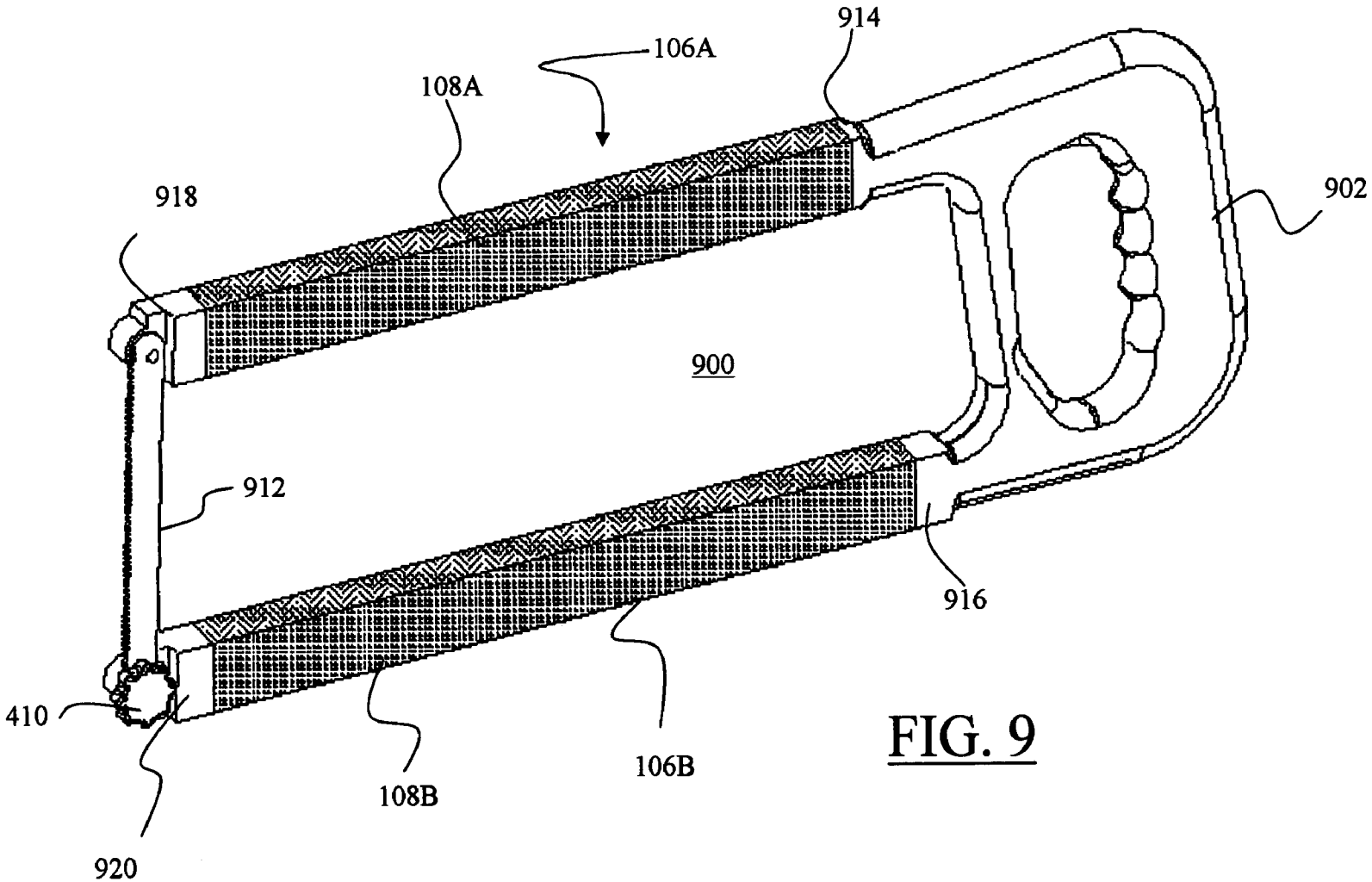
FIG. 9 is an exemplary illustration of still a further embodiment for a single piece four-sided hacksaw with two files as an integral part of the hacksaw frame in accordance with the present invention.

FIG. 9 is an exemplary illustration of a further embodiment of a hacksaw 900 with a frame design having two longitudinal positioned files as an integral part of the hacksaw frame in accordance with the present invention. The hacksaw 900 includes similar corresponding or equivalent components as those illustrated in FIGS. 1A to 8, and described above. Therefore, for the sake of brevity, clarity, convenience, and to avoid duplication the general description of FIG. 9 will not repeat every corresponding or equivalent component that has already been described above in relation to hacksaws that are shown in FIGS. 1A to 8.

As illustrated in FIG. 9, the hacksaw 900 is comprised of a structure having a frame, including a handle 902. The hacksaw 900 further includes a first elongated beam 106A that has a series of ridges on at least one or more surfaces of the first elongated beam 106A that form a first file 108A for reducing and smoothing surfaces of an article. Also included with hacksaw 900 is a second elongated beam 106B that has a series of ridges on at least one or more surfaces of the second elongated beam 106B that form a second file 108B for reducing and smoothing surfaces of an article. The first elongated beam 106A has a first distal end 914 that is coupled with one of a first handle section and a second handle section, and the second elongated beam 106B has a second distal end 916 that is coupled with another of first handle section and the second handle section. The hacksaw blade 912 is coupled with a third distal end 918 of the first elongated beam 106A and a fourth distal end 920 of the second elongated beam 106B.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. For example, the cross-section of the file 108 may differ from the cross-section of the distal ends 208 and 116, and each of the distal ends 208 and 116 may have different cross-sections. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A hacksaw comprising:

a structure having a frame, including:

a back handle having a first back handle section;

a fore piece having a first front section;

and an elongated beam having a series of ridges on at least one or more surfaces of the elongated beam forming a file designed to reduce and smooth surfaces of an article; wherein the elongated beam has a longitudinal axis as well as first and second ends each having a cross-section, wherein the first and second ends are equidistant from a center of the elongated beam;

the first front section comprises a first fore section;

the first fore section includes a first radial array of receiving channels, and each receiving channel of the first radial array is commensurate with the cross-section of the first end of the elongated beam;

the first back handle section includes a second radial array of receiving channels, and each receiving channel of the second radial array is commensurate with the cross-section of the second end of the elongated beam;

the first and second radial arrays are used to detachably secure the elongated beam between the fore piece and the back handle in fixed orientations by insertion of the first end of the elongated beam into a channel of the first radial array of receiving channels and insertion of the second end of the elongated beam into a channel of the second radial array of receiving channels;

detachably securing the elongated beam allows for detachment of the elongated beam from the fore piece and back handle such that after removal a user can rotate the elongated beam around the longitudinal axis then reinsert the first and second ends of the elongated beam into different channels of the first and second radial array of receiving channels respectively to change the orientation of the elongated beam, and therefore the file, with respect to the fore piece and back handle section; and the hacksaw further comprises a hacksaw blade coupled to the back handle and the fore piece.

2. The hacksaw as set forth in claim 1, wherein: the elongated beam has a polygonal cross-section.

3. The hacksaw as set forth in claim 1, wherein: the hacksaw blade includes a first end and a second end;

the first end of the hacksaw blade is coupled with a second front section of the fore piece, and the second end of the hacksaw blade is coupled with a second back handle section of the back handle.

* * * * *